US010133209B2

(12) United States Patent
Yamabe

(10) Patent No.: US 10,133,209 B2
(45) Date of Patent: Nov. 20, 2018

(54) POWDER CONTAINER AND IMAGE FORMING DEVICE

(71) Applicant: Junji Yamabe, Shizuoka (JP)

(72) Inventor: Junji Yamabe, Shizuoka (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 15/543,102

(22) PCT Filed: Jan. 6, 2016

(86) PCT No.: PCT/JP2016/050279

§ 371 (c)(1),
(2) Date: Jul. 12, 2017

(87) PCT Pub. No.: WO2016/114203

PCT Pub. Date: Jul. 21, 2016

(65) Prior Publication Data

US 2018/0004121 A1 Jan. 4, 2018

(30) Foreign Application Priority Data

Jan. 14, 2015 (JP) ..... 2015-005407

(51) Int. Cl.
*G03G 15/08* (2006.01)

(52) U.S. Cl.
CPC ..... *G03G 15/087* (2013.01)

(58) Field of Classification Search
None
See application file for complete search history.

(56) References Cited

U.S. PATENT DOCUMENTS 6,023,594 A * 2/2000 Okiyama ..... G03G 15/0872 399/112
8,929,776 B2 1/2015 Yamabe et al.
(Continued)

FOREIGN PATENT DOCUMENTS

EP 3 177 969 A1 6/2017
JP 06-214459 8/1994
(Continued)

OTHER PUBLICATIONS

International Search Report dated Apr. 5, 2016 in PCT/JP2016/050279 filed Jan. 6, 2016.
(Continued)

*Primary Examiner* — Victor Verbitsky
(74) *Attorney, Agent, or Firm* — Oblon, McClelland, Maier & Neustadt, L.L.P.

(57) ABSTRACT

In a toner container, a powder container that includes a container body configured to store toner, and is rotated by input of rotational drive of a drive output section of an image forming device while being set in the image forming device, the toner container includes an incompatible hole group, as a container-side engagement portion, on a front end surface facing downstream in an insertion direction when inserted in a direction parallel to a rotational center line of the rotational drive and set in the image forming device, the incompatible hole group has a hole shape that is engaged with a body-side projection portion of the drive output section protruding upstream in the insertion direction, and the rotational drive is input by rotation of the drive output section with the incompatible hole group and the body-side projection portion engaged with each other.

6 Claims, 23 Drawing Sheets

(56) References Cited

U.S. PATENT DOCUMENTS

| | | | | |
|---|---|---|---|---|
| 8,929,777 | B2 | 1/2015 | Yamabe et al. | |
| 8,929,780 | B2 | 1/2015 | Yamabe et al. | |
| 8,934,816 | B2 | 1/2015 | Yamabe et al. | |
| 8,989,636 | B2 | 3/2015 | Hori et al. | |
| 2007/0212119 | A1 | 9/2007 | Kurenuma et al. | |
| 2010/0209141 | A1* | 8/2010 | Ikado ..... | G03G 21/1647 399/119 |
| 2010/0296847 | A1 | 11/2010 | Kurenuma et al. | |
| 2014/0241757 | A1 | 8/2014 | Kikuchi et al. | |
| 2014/0270859 | A1 | 9/2014 | Hosokawa et al. | |
| 2014/0320906 | A1 | 10/2014 | Fujimori et al. | |
| 2014/0348551 | A1 | 11/2014 | Yamabe et al. | |
| 2015/0147096 | A1 | 5/2015 | Hori et al. | |
| 2016/0033898 | A1 | 2/2016 | Yamabe et al. | |

FOREIGN PATENT DOCUMENTS

| | | |
|---|---|---|
| JP | 2006-058698 | 3/2006 |
| JP | 2006-154318 A | 6/2006 |
| JP | 2007-321773 | 12/2007 |
| JP | 2010-191016 | 9/2010 |
| JP | 2014-145793 | 8/2014 |
| JP | 2014-219436 | 11/2014 |
| WO | 2014/142353 | 9/2014 |
| WO | WO 2016/021200 A1 | 2/2016 |

OTHER PUBLICATIONS

Extended European Search Report dated Dec. 15. 2017 in Patent Application No. 16737274.7, 9 pages.

* cited by examiner

POWDER CONTAINER AND IMAGE FORMING DEVICE

FIELD

The present invention relates to a powder container and an image forming device.

BACKGROUND

As a toner container that stores toner used for an image forming device in the related art, one that is attachable to and detachable from an image forming device body and replaced with a new toner container that stores toner when toner stored therein runs out is known.

Patent Literature 1 describes a toner container with a driving gear that protrudes outside an outer peripheral surface of a columnar shape. This toner container is set in an image forming device such that a central axis of the columnar shape is horizontal, and is driven at a driving gear to be rotationally driven to transfer toner therein in a direction from one end to the other end.

SUMMARY

Technical Problem

However, with the toner container in Patent Literature 1, when the toner container falls, for example, the driving gear protruding outside the outer peripheral surface of the columnar shape may hit, for example, a floor and be damaged. Damage to a driving gear having a function to receive rotational drive makes it difficult to rotationally drive a toner container. Therefore, there is a need for a configuration that can suppress damage to a portion having a function to receive rotational drive when a toner container falls, for example.

Such a problem is not limited to a toner container that rotates by input rotational drive, and similar problems may occur in a configuration where a rotating member arranged inside a toner container rotates.

Solution to Problem

In order to solve the above problem, the invention according to claim 1 is a powder container including a powder storage unit configured to store powder, wherein the powder storage unit or a rotating member arranged inside the powder storage unit is rotated by input of rotational drive of a drive output section of an image forming device in a state where the powder container is set in the image forming device, the powder container includes a container-side engagement portion on an end surface facing downstream in an insertion direction when the powder container is inserted in a direction parallel to a rotational center line of the rotational drive and set in the image forming device, the container-side engagement portion has a hole shape that is engaged with a body-side projection portion of the drive output section, the body-side projection portion protruding upstream in the insertion direction, and the rotational drive is input by rotation of the drive output section in a state where the container-side engagement portion and the body-side projection portion are engaged with each other.

Advantageous Effects of Invention

According to the present invention, damage to a portion having a function to receive rotational drive can advantageously be suppressed when a powder container falls, for example.

BRIEF DESCRIPTION OF DRAWINGS

FIG. 28-1 is a side view of the cap member in the example; and

FIG. 28-2 is a side view of the cap member in the modification.

DESCRIPTION OF EMBODIMENTS

An embodiment of the present invention will be described below with reference to the drawings.

Figure 2:
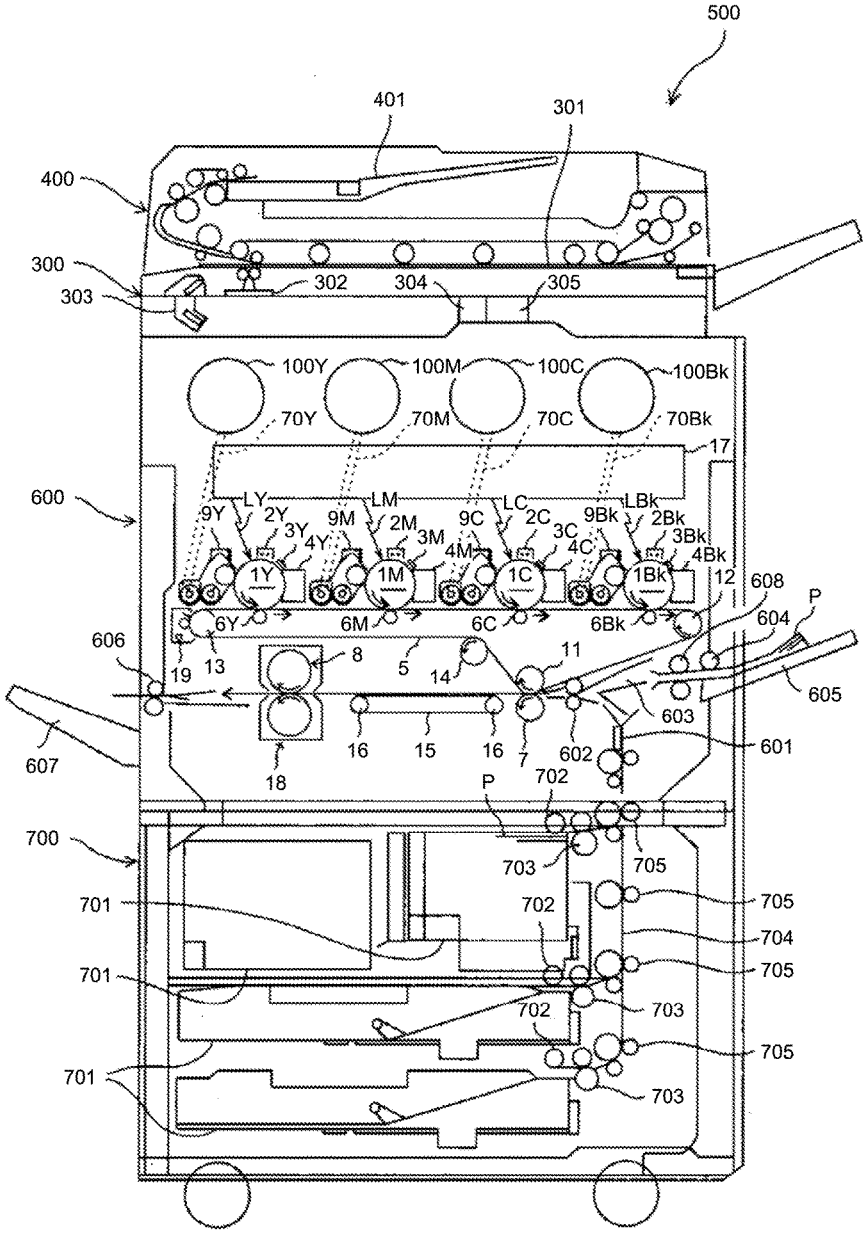
FIG. 2 is a schematic configuration view of a copy machine according to an embodiment.

FIG. 2 is a schematic configuration view illustrating a schematic configuration of a copy machine 500 as an image forming device to which the present invention can be applied. The copy machine 500 includes a printer unit 600, a paper feeding table 700 on which the printer unit 600 is placed, and a scanner 300 fixed on the printer unit 600. Also included is an automatic original conveying device 400 fixed on this scanner 300.

The copy machine 500 in the present embodiment is a so-called tandem image forming device. In the copy machine 500, image data that are image information read from the scanner 300 and print data from external devices such as a personal computer are received to form images on a sheet P, a recording medium. In the printer unit 600, as illustrated in FIG. 2, four drum-shaped photoconductors 1 (Y, M, C, Bk) that are latent image bearers, each for yellow (Y), magenta (M), cyan (C), and black (Bk) are juxtaposed with one another. These photoconductors 1 (Y, M, C, Bk) are arranged in juxtaposition so as to come into contact with an endless belt type intermediate transfer belt 5 along a direction of the belt movement.

Around each of the photoconductors 1, a charger 2 (Y, M, C, Bk), a developing device 9 (Y, M, C, Bk), a photoconductor cleaning device 4 (Y, M, C, Bk), a discharge lamp 3 (Y, M, C, Bk), and the like for each color are arranged in an order of process. An optical writing device 17 is provided above the four photoconductors 1. In addition, at opposite positions of the photoconductors 1 via the intermediate transfer belt 5, primary transfer rollers 6 (Y, M, C, Bk) are arranged.

The intermediate transfer belt 5 is bridged over three supporting rollers (11, 12, 13) and a tension roller 14, and rotationally driven by rotation of a driving roller 12 that is rotationally driven by a driving source. At an opposite position of a cleaning counter roller 13 via the intermediate transfer belt 5, a belt cleaning device 19 is provided to remove residual toner remaining on the intermediate transfer belt 5 after secondary transfer. In addition, a secondary transfer counter roller 11, one of the supporting rollers, is a roller facing a secondary transfer roller 7 and forms a secondary transfer nip portion with the secondary transfer roller 7 via the intermediate transfer belt 5.

Downstream of this secondary transfer nip portion in a sheet conveying direction, a sheet conveying belt 15 stretched over a supporting roller pair 16 is provided to convey a sheet P, on which a toner image is secondarily transferred, to a fixing device 18. The fixing device 18 includes a fixing roller pair 8 including a heating roller and a pressure roller, and applies heat and pressure at the fixing nip portion to fix an unfixed toner image on the sheet P.

Next, a copy operation of the copy machine 500 in the present embodiment will be described.

In a case where a full-color image is formed with the copy machine 500 according to the present embodiment, firstly an original is set on an original platen 401 of the automatic original conveying device 400. Alternatively, the automatic original conveying device 400 is opened to set an original on a contact glass 301 of the scanner 300 and closed to hold the original.

Subsequently, once a user pushes down a start switch, the original is conveyed onto the contact glass 301 when set on the automatic original conveying device 400. Then, the scanner 300 is driven to make a first traveling body 302 and a second traveling body 303 start traveling. As a result, light emitted from the first traveling body 302 is reflected by the original on the contact glass 301, and the reflected light is reflected by a mirror of the second traveling body 303 and guided to a reading sensor 305 through an imaging forming lens 304. In this way, image information of the original is read.

Additionally, when a start switch is pushed down by a user, a motor is driven, and the driving roller 12 is rotationally driven to rotationally drive the intermediate transfer belt 5. At the same time, a yellow photoconductor 1Y is uniformly charged by a yellow charger 2Y while being rotationally driven by a photoconductor driving device in a direction of an arrow in the figure. Then, a yellow optical beam Ly from the optical writing device 17 is emitted to form a Y electrostatic latent image on the yellow photoconductor 1Y. This Y electrostatic latent image is developed by a yellow developing device 9Y using Y toner contained in developer. During development, a predetermined developing bias is applied to a developing roller, and the Y toner on the developing roller is electrostatically attracted to a portion of the Y electrostatic latent image on the yellow photoconductor 1Y.

A Y toner image thus developed and formed is conveyed to a primary transfer position where the yellow photoconductor 1Y and the intermediate transfer belt 5 come into contact with each other with rotation of the yellow photoconductor 1Y. At this primary transfer position, a predetermined bias voltage is applied to a rear surface of the intermediate transfer belt 5 by a yellow primary transfer roller 6Y. Then, a primary transfer electric field generated by this bias application draws the Y toner image on the yellow photoconductor 1Y toward the intermediate transfer belt 5 to primarily transfer the Y toner image on the intermediate transfer belt 5. Similarly, an M toner image, a C toner image, and a Bk toner image are primarily transferred so as to be sequentially superimposed on the intermediate transfer belt 5 on which the Y toner image is formed.

Furthermore, when a start switch is pushed down by a user, a paper feeding roller 702 corresponding to a sheet selected by the user on the paper feeding table 700 is rotated to send out a sheet P from one of paper feeding cassettes 701. The sheet P is separated by a paper separating roller 703 into one piece to enter a paper feeding route 704, conveyed by a conveying roller pair 705 to an in-printer paper feeding route 601 provided in the printer unit 600, and stopped where to butt a registration roller pair 602. In a case where the sheet P is set in a manual paper feeding tray 605, the sheet P is sent out by a manual paper feeding roller 604 and separated into one piece by a manual paper separating roller 608. Then, the sheet P is conveyed through a manual paper feeding route 603 and stopped where to butt the registration roller pair 602.

A synthesized toner image formed by superimposing and transferring a plurality of colors on the intermediate transfer belt 5 is conveyed to a secondary transfer position facing the secondary transfer roller 7 with the rotation of the intermediate transfer belt 5. The registration roller pair 602 starts rotation at a timing when the synthesized toner images formed on the intermediate transfer belt 5 are conveyed to the secondary transfer position, and conveys the sheet P to the secondary transfer position. At the secondary transfer position, a predetermined bias is applied on a rear surface of the sheet P by the secondary transfer roller 7, and by a contact pressure generated by the bias application in a secondary transfer electric field and the secondary transfer position, the synthesized toner images on the intermediate transfer belt 5 are collectively secondarily transferred on the sheet P. The sheet P on which the synthesized toner images are secondarily transferred is conveyed to the fixing device 18 by the sheet conveying belt 15 and subjected to fixing processing by the fixing device 18. The sheet P subjected to fixing processing is ejected and stacked by a paper ejecting roller pair 606 on a paper ejecting tray 607 provided outside the device. Transfer residual toner remaining on the intermediate transfer belt 5 after the secondary transfer is removed by the belt cleaning device 19.

Next, toner supply devices 70, powder conveying devices that convey toner in toner containers 100 to the developing devices 9, will be described. The four developing devices 9 (Y, N, C, Bk) are supplied with toner corresponding to each color by the toner supply devices 70 with identical configurations. Therefore, descriptions will be given with codes Y, N, C, and Bk corresponding to each color omitted.

Figure 3:
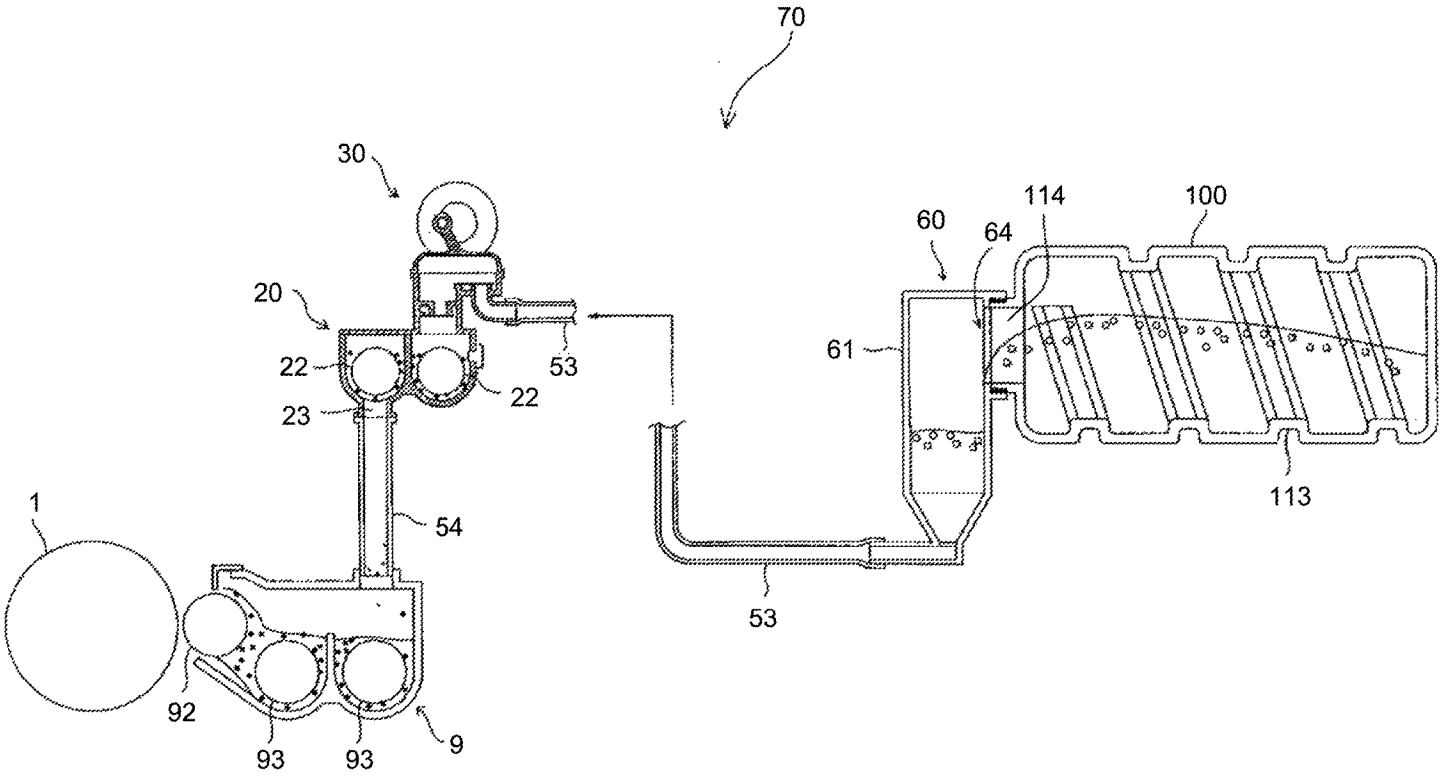
FIG. 3 is a schematic configuration view of a developing device and a toner supply device according to the embodiment.

FIG. 3 schematically illustrates each of the developing devices 9 and the toner supply devices 70.

In the present embodiment, replenisher that is stored in each toner container 100 and supplied to the developing device 9 by the toner supply device 70 is a mixture of toner and carrier, but may be configured to supply only toner.

As illustrated in FIG. 3, the toner supply device 70 includes a toner receiving unit 60, a diaphragm pump 30, and a sub-hopper 20.

The toner receiving unit 60 is connected with the toner container 100, a replenisher container attachable to and detachable from the printer unit 600.

The toner container 100 has helical conveying grooves 113 formed to protrude into a hollow and columnar interior, and is rotationally driven to convey the stored replenisher toward an outlet 114. Then, the replenisher conveyed to the outlet 114 is fed into a container 61 from an inlet 64 formed in the container 61 of the toner receiving unit 60.

The replenisher in the container 61 is sucked out with air by the diaphragm pump 30, a powder conveying pump and fed into the sub-hopper 20 through a tube 53. The replenisher fed into the sub-hopper 20 that temporarily pools replenisher reaches a toner electing opening portion 23 by rotation of a conveying screw 22 in the sub-hopper 20 and is supplied into the developing device 9 through a toner duct 54.

The developing device 9 includes a developing roller 92 that supports and conveys two-component developer consisting of toner and carrier to a developing area facing the photoconductor 1, and a stirring and conveying screw 93 that stirs and conveys developer fed to the developing roller 92.

A toner concentration sensor is attached to the developing device 9, and detects a decline in toner concentration when toner in the developing device 9 is consumed. Then, replenisher containing a consumed amount of toner is supplied from the sub-hopper 20 to keep the toner concentration in the developing device 9 constant.

The replenisher stored in the toner container 100 includes, as described above, toner and carrier mixed, and when the replenisher is supplied in the developing device 9, external additives added into toner and carrier also enter the developing device 9 with toner. Carrier is not consumed in a developing section and thus increases, but overflows to be ejected from an outlet included in the developing device 9 when a certain level is exceeded.

The toner container 100 will be described below, but in descriptions below, toner stored in the toner container 100 is not limited to only toner and may contain carrier as with the replenisher described above.

[Reference Configuration Example]

Next, a reference configuration example of a toner container 100 attachable to and detachable from the copy machine 500 in the present embodiment will be described.

Figure 4:
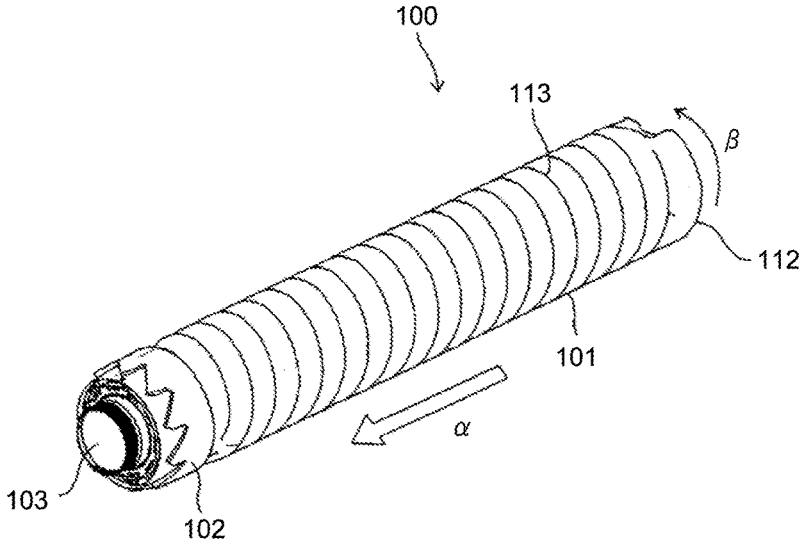
FIG. 4 is a perspective illustrative view of a toner container in a reference configuration example from a front end side in an insertion direction.

FIG. 4 is a perspective illustrative view of the toner container 100 in the reference configuration example from a front end side in an insertion direction (downstream side in an insertion direction). An arrow α direction in FIG. 4 is an insertion direction of the toner container 100.

The toner container 100 consists of a container body 101 and a cap member (cover member) 102. The container body 101 stores toner. The container body 101 is column-shaped, and one end of the columnar shape in a central axis direction is a bottom 112 and closed. The other end of the container body 101 in the central axis direction is provided with an opening corresponding to an outlet 114 that is configured to eject toner stored therein and that will be described later.

The cap member 102 covers an outer periphery of a tip at the other end of the container body 101. An outer lid 103 is attached to the toner container 100 when the toner container 100 is not used such as during conveyance or storage of the toner container 100, and covers the outlet 114 that ejects toner in the container body 101. The container body 101 is also provided with conveying grooves 113 as a conveying means for conveying toner to be stored. By rotation of the container body 101 in a direction in the figure with a configuration which will be described later, toner is conveyed in a direction from the bottom 112 toward the outlet 114 through the conveying grooves 113. At this time, the cap member 102 also rotates with the container body 101.

As indicated by the a arrow in FIG. 4, the toner container 100 is inserted into the copy machine 500 from the end at the cap member 102.

Hereinafter, the direction toward the cap member 102 (other end) in the toner container 100 is defined to be downstream in the insertion direction, while the direction toward the bottom 112 (one end) opposite to the direction toward the cap member 102 in a longitudinal direction is defined to be upstream in the insertion direction. By rotation of the toner container 100, toner in the container body 101 is conveyed from the upstream side in the insertion direction to the downstream side therein.

An upstream side in a toner conveying direction is the upstream side in the insertion direction, while a downstream side in the toner conveying direction is the downstream side in the insertion direction. A direction perpendicular to a central axis of the column-shaped container body 101 is called a radial direction. A direction toward the central axis in the radial direction is called a central direction, while a direction toward the outer periphery of the container body 101 is called an outer peripheral direction.

Figure 5:
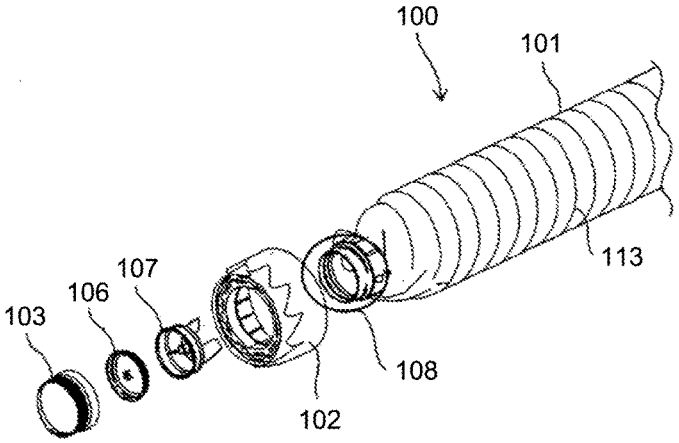
FIG. 5 is an exploded perspective view of the toner container in the reference configuration example.

FIG. 5 is an exploded perspective view of the toner container 100 in the reference configuration example. As illustrated in FIG. 5, an ejecting member 107, an inner lid 106, and an outer lid 103 besides the cap member 102 are attached to the container body 101.

Figure 6:
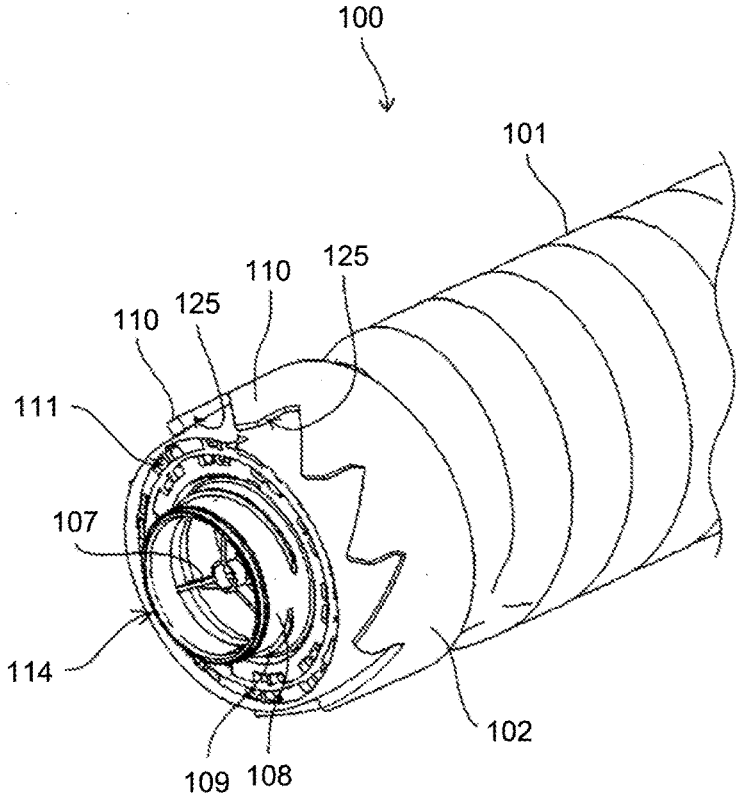
FIG. 6 is an enlarged perspective view of a toner container in the reference configuration example with outer and inner lids removed from a state in FIG. 4 near a downstream end in an insertion direction.

FIG. 6 is an enlarged perspective view of the toner container 100 with the outer lid 103 and the inner lid 106 removed from a state of FIG. 4 near the downstream end in the insertion direction.

The container body 101 is provided with an opening portion 108 protruding downstream in the insertion direction. A tip end of the opening portion 108 is the outlet 114 that ejects toner therein.

As illustrated in FIG. 6, the opening portion 108 is cylindrical, and the ejecting member 107 is fitted on an inner side (inner wall surface) of the opening portion 108. Before use, the inner lid 106 that covers the outlet 114 is fitted into the opening portion 108.

As illustrated in FIG. 4, the outer lid 103 is a screw cap removably provided to cover the outlet 114. As illustrated in FIG. 6, on an outer periphery of the opening portion 108, an outer lid fixing portion 109 that helically protrudes along the outer periphery is provided such that the outer lid 103 functions as a screw cap. The outer lid 103 is attached to the opening portion 108 by engagement of helical grooves cut in an inner periphery of the outer lid 103 with the outer lid fixing portion 109.

As illustrated in FIG. 5, the cap member 102 is provided with an opening in a center thereof in a radial direction, and as illustrated in FIGS. 5 and 6, the opening portion 108 of the container body 101 is configured to protrude from the opening. The cap member 102 in the reference configuration example is provided with a drive receiving section 110 on an outer periphery thereof. In addition, on a downstream end surface in the insertion direction, an incompatible hole group 111 formed of a combination of a plurality of incompatible holes (through holes, hollows) is provided as an incompatible section. The incompatible hole group 111 consists of an outer peripheral-side incompatible hole group 111*a* and an inner peripheral-side incompatible hole group 111*b*, both of which include a plurality of holes on a concentric circle around a central axis of the column-shaped toner container 100. Incompatibility is a configuration for identifying, for example, differences in color and characteristic of stored toner, and type of an image forming device body to prevent erroneous insertion of a toner container 100.

Figure 7:
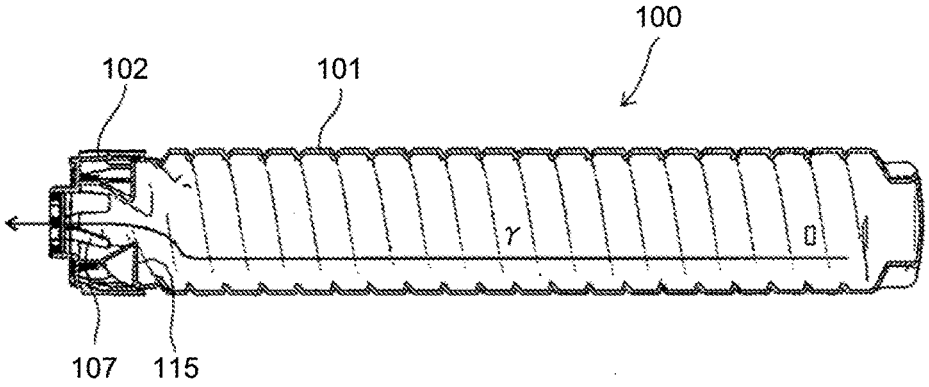
FIG. 7 is a sectional side view of a cross section passing through a center line of a cylindrical shape of the toner container in the reference configuration example.

FIG. 7 is a sectional side view of a cross section passing through a center line of a cylindrical shape of the toner container 100 in the reference configuration example. An arrow γ in FIG. 7 roughly indicates a flow of toner stored in the container body 101.

As illustrated in FIG. 7, a container scooping portion 115 where an outer periphery thereof protrudes toward inside in the radial direction is provided near the opening portion 108 of the container body 101. The container scooping portion 115 scoops toner conveyed thereto with rotation upward from below as well as transfers the scooped toner to the ejecting member 107 and conveys the toner to the outlet 114.

Figure 8:
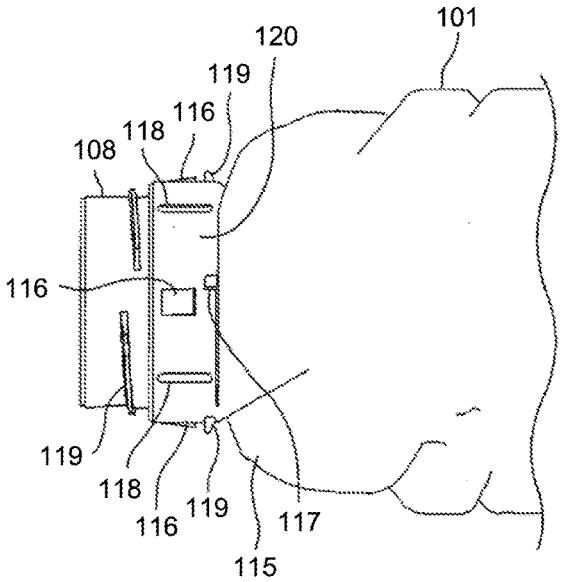
FIG. 8 is an enlarged side view of only a container body in the reference configuration example with a cap member removed from the toner container near a downstream end in an insertion direction.
Figure 9:
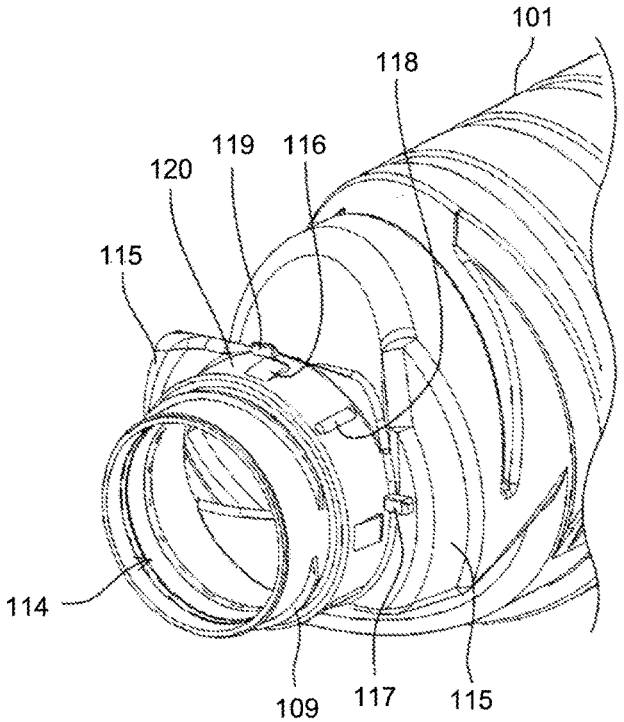
FIG. 9 is an enlarged perspective view of only a container body in the reference configuration example near a downstream end in an insertion direction.

FIG. 8 is an enlarged side view of only the container body 101 in the reference configuration example with the cap member 102 removed from the toner container 100 near the downstream end in the insertion direction, and FIG. 9 is an enlarged perspective view of only the container body 101 in the reference configuration example near the downstream end in the insertion direction.

A cylindrical opening-portion base 120 is provided between the opening portion 108 of the container body 101 and the container scooping portion 115. Retaining projections 116, circumference determining projections 118, axial-direction restricting projections 119, and circumferential-direction restricting projections 117 are provided on an outer peripheral surface of the opening-portion base 120.

Each of the retaining projections 116 has an inclined surface which heightens from the downstream side toward the upstream side in the insertion direction on the opening-portion base 120, and a vertical surface extending inward in the radial direction on the upstream side in the insertion direction. Each of the circumference determining projections 118 is a projection that extends in the insertion direction, and a height (protrusion amount) thereof is fixed. Each of the axial-direction restricting projections 119 includes a surface rising vertically from the downstream side in the insertion direction, at a distance from an upstream end of the retaining projection 116 in the insertion direction (space where a retaining rib 121 of the cap member 102 is sandwiched). The axial-direction restricting projection 119 further includes an inclined surface where a protrusion amount decreases from the surface toward the upstream side in the insertion direction. Each of the circumferential-direction restricting projections 117 is a projection with a surface on a plane flush with the surface of the axial-direction restricting projection 119 rising vertically, and protrudes (extends) longer outward in the radial direction than the axial-direction restricting projection 119.

Next, the cap member 102 in the reference configuration example will be described.

Figure 10:
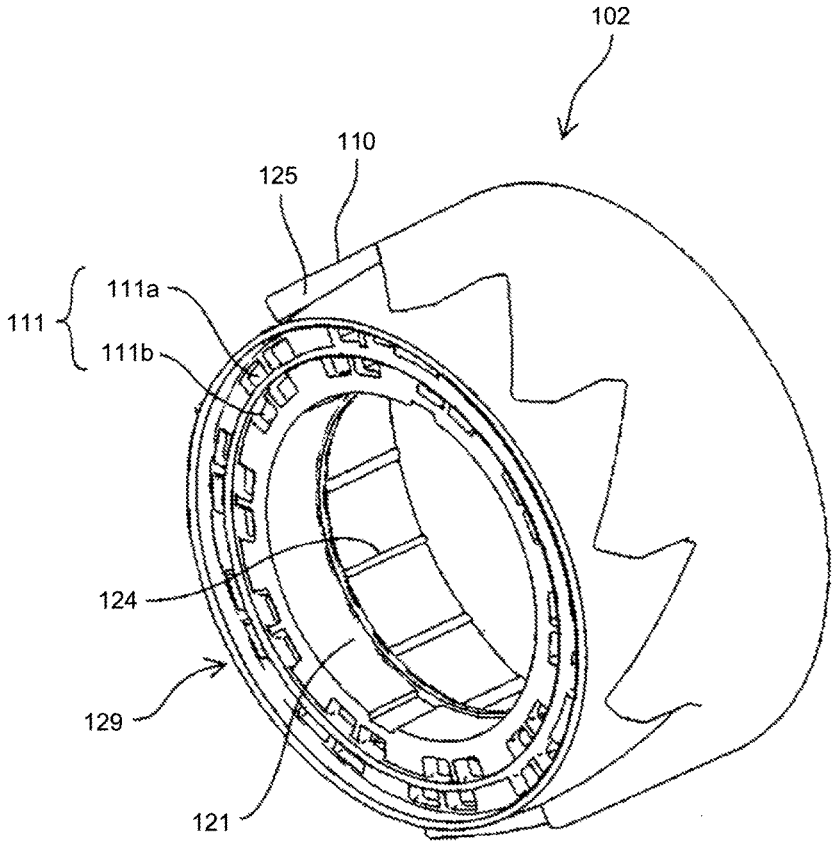
FIG. 10 is a perspective view of the cap member in the reference configuration example from other end side (downstream side in an insertion direction)
Figure 11:
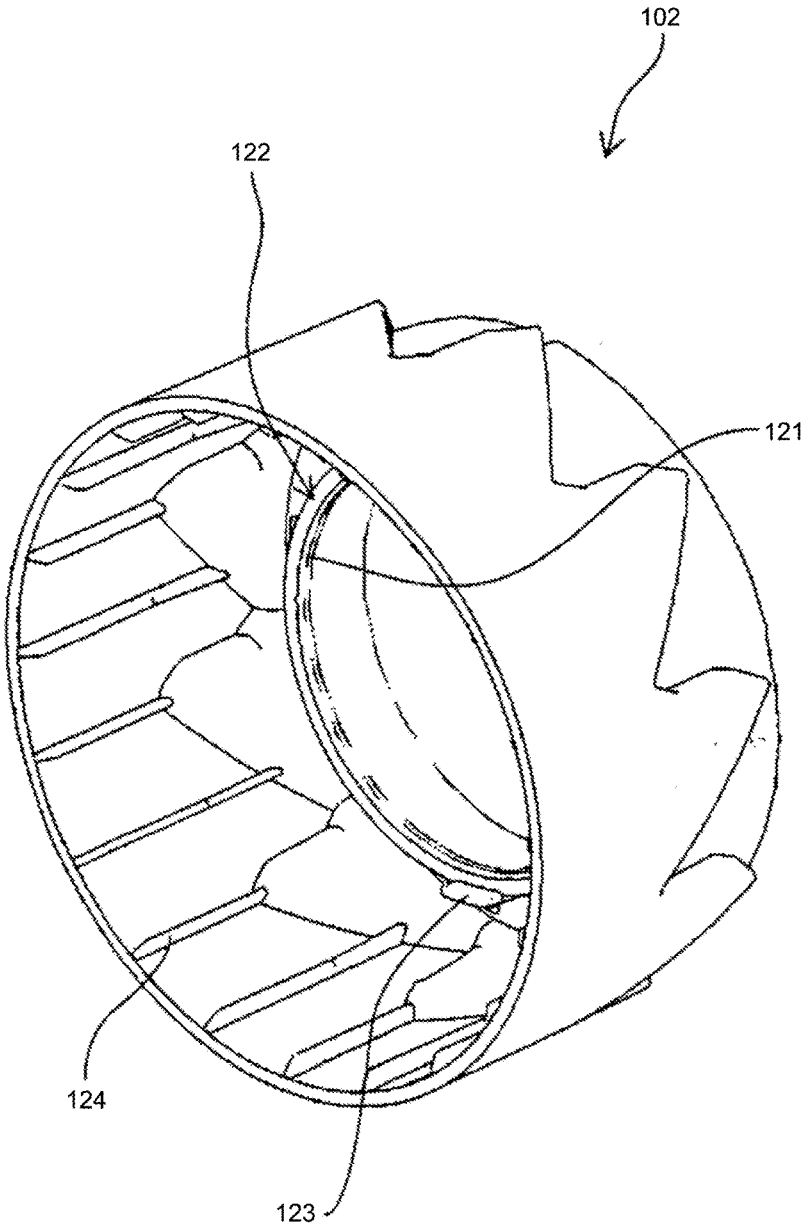
FIG. 11 is a perspective view of the cap member in the reference configuration example from one end side (upstream side in an insertion direction)
Figure 12:
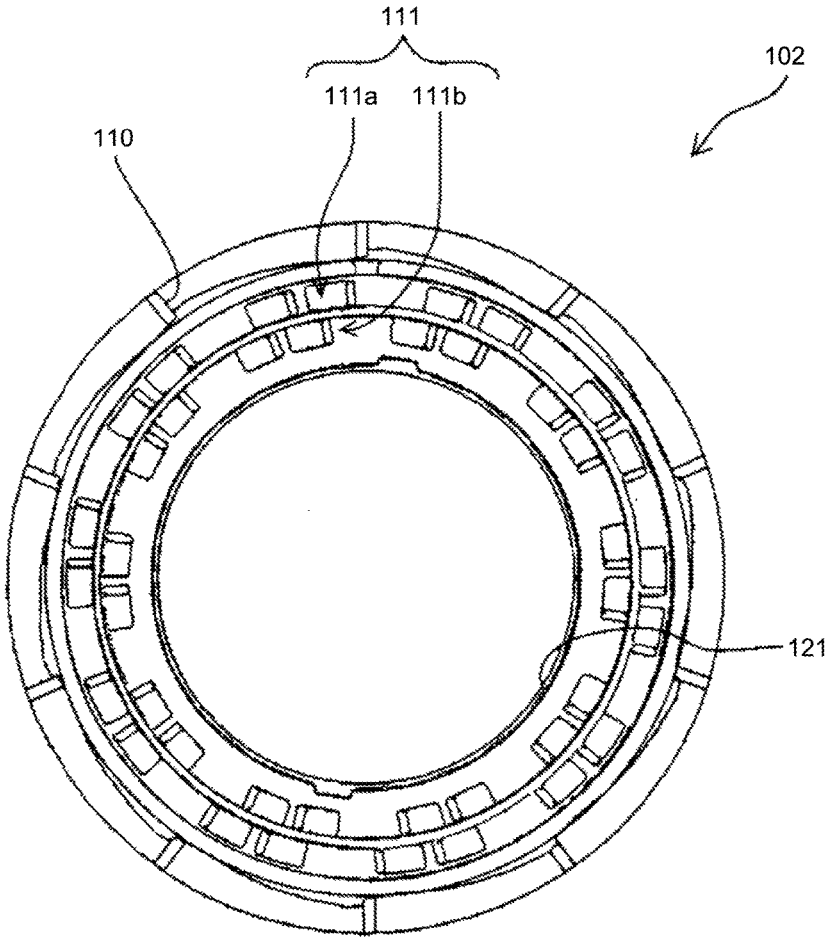
FIG. 12 is a front view of the cap member in the reference configuration example from other end side (downstream side in an insertion direction)

FIG. 10 is a perspective view of the cap member 102 in the reference configuration example from the other end side (downstream side in the insertion direction), and FIG. 11 is a perspective view of the cap member 102 in the reference configuration example from one end side (upstream side in the insertion direction). FIG. 12 is a front view of the cap member 102 in the reference configuration example from the other end side (downstream side in the insertion direction).

The cap member 102 is cylindrically shaped and at the center thereof, the opening for the opening portion 108 of the container body 101 to protrude is formed. In an inner peripheral section of the opening of the cap member 102, the retaining rib 121 that protrudes toward the center protrudes around the inner periphery. The upstream side of the retaining rib 121 in the insertion direction forms an axial-direction butting surface 122. In addition, a circumferential-direction restricting butting projection 123 that protrudes toward the upstream side in the insertion direction is provided on a portion of the axial-direction butting surface 122 on the retaining rib 121.

On an inner peripheral surface of the cylindrical cap member 102, a plurality of backlash eliminating projections 124 that extends in the inserting direction is provided at a predetermined distance in the circumferential direction.

On an outer peripheral section of the cap member 102 in the reference configuration example, drive receiving sections 110 including drive-transmitted surfaces (drive-transmitted portions) 125 are provided.

Figure 13:
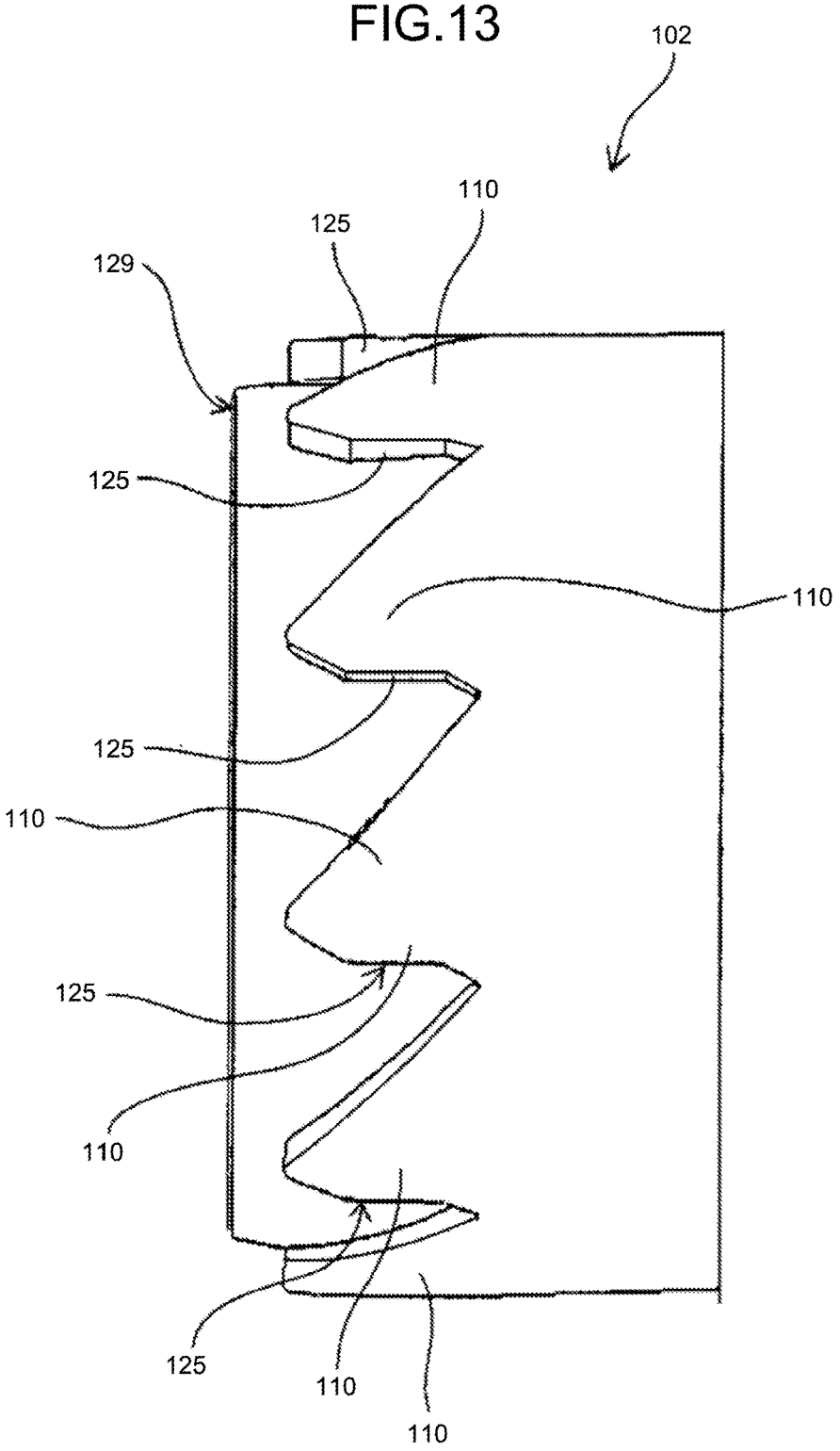
FIG. 13 is a side view of the cap member in the reference configuration example.

FIG. 13 is a side view of the cap member 102 in the reference configuration example.

Each of the drive-transmitted surfaces 125 is a wall surface rising outward in the radial direction from an outer periphery of the cap member 102.

A plurality of the drive receiving sections 110 including the drive-transmitted surfaces 125 is continuously provided in juxtaposition in the circumferential direction on the outer periphery of the cap member 102.

As illustrated in FIGS. 10 and 13, for example, downstream ends of the drive receiving sections 110 in the insertion direction are in a sharp shape.

Next, engagement between the cap member 102 on the toner container 100 and the container body 101 will be described.

Figure 14:
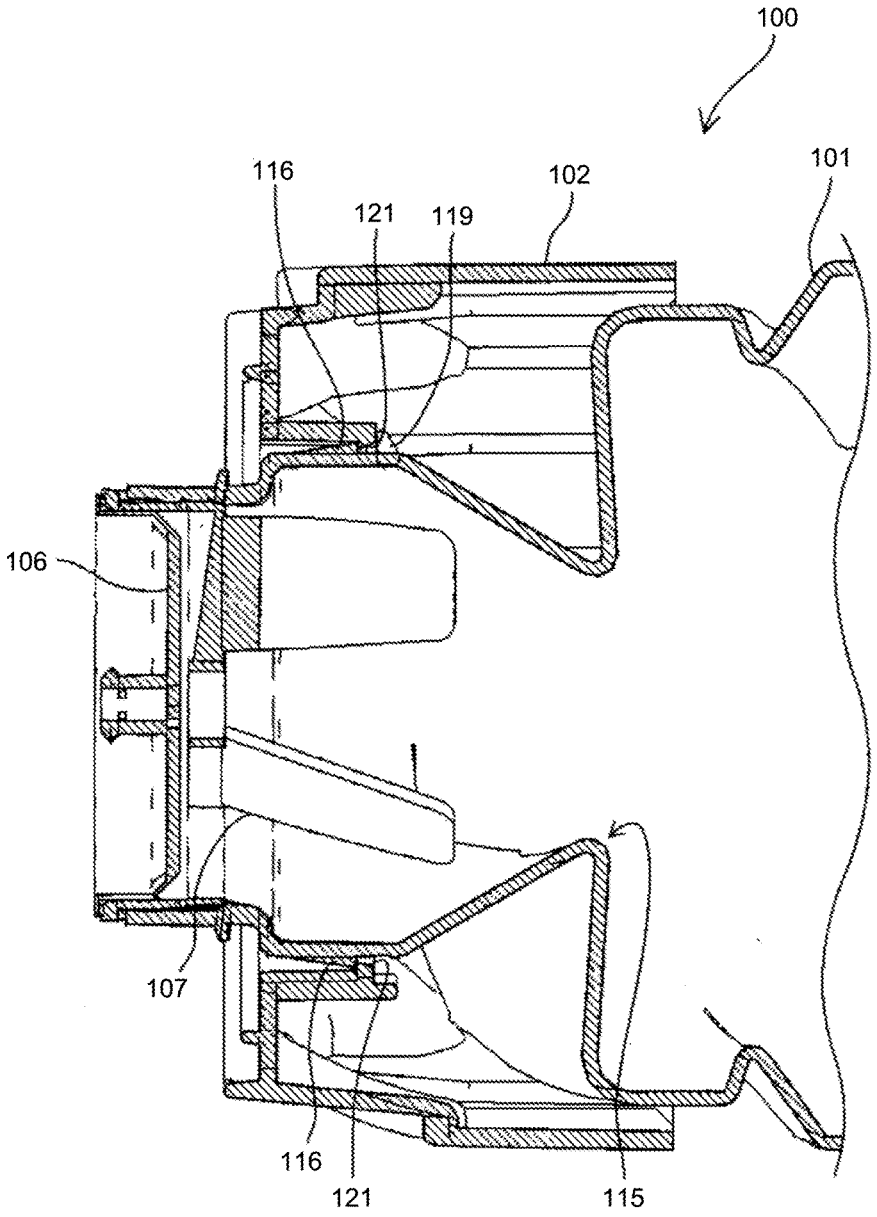
FIG. 14 is an enlarged sectional side view of the toner container in the reference configuration example near a downstream end in an insertion direction.

FIG. 14 is an enlarged sectional side view of the toner container 100 in the reference configuration example near the downstream end in the insertion direction.

As illustrated in FIG. 8, the retaining projections 116 are provided on the opening-portion base 120 of the container body 101. Thus, when the cap member 102 is attached to the container body 101, as illustrated in FIG. 14, the retaining rib 121 of the cap member 102 is caught at these retaining projections 116 to prevent the cap member 102 from coming off.

In addition, as illustrated in FIG. 8, the axial-direction restricting projections 119 are provided on the opening-portion base 120 of the container body 101. Thus, when the cap member 102 is attached to the container body 101, as illustrated in FIG. 14, the axial-direction butting surface 122 of the retaining rib 121 of the cap member 102 butts these axial-direction restricting projections 119. This butting prevents the cap member 102 from intruding further toward the container body 101.

Similarly, the axial-direction butting surface 122 of the cap member 102 butts the circumferential-direction restricting projections 117 of the container body 101 illustrated in FIG. 8 to restrict movement of the cap member 102.

As illustrated in FIG. 14, intrusion of the retaining rib 121 of the cap member 102 between the retaining projections 116 and the axial-direction restricting projections 119 restricts forward/backward movement of the cap member 102 in the axial direction.

The circumferential-direction restricting projections 117 are provided so as to extend outside the axial-direction restricting projections 119 against the axial direction of the container body 101. The circumferential-direction restricting butting projection 123 of the cap member 102 is caught at the circumferential-direction restricting projections 117, which allows the container body 101 to rotate with rotation of the cap member 102. Furthermore, until the circumferential-direction restricting butting projection 123 of the cap member 102 is caught at the circumferential-direction restricting projections 117, it is possible for the cap member 102 to rotate in a predetermined angular range against the container body 101.

These restrictions in axial and circumferential directions make it possible to rotatably fix the cap member 102 in a predetermined angular range against the container body 101 in the circumferential direction.

Next, a container housing unit 200, into which the toner container 100 is inserted, of the toner supply device 70 of the body of the copy machine 500 in the present embodiment will be described.

Figure 15:
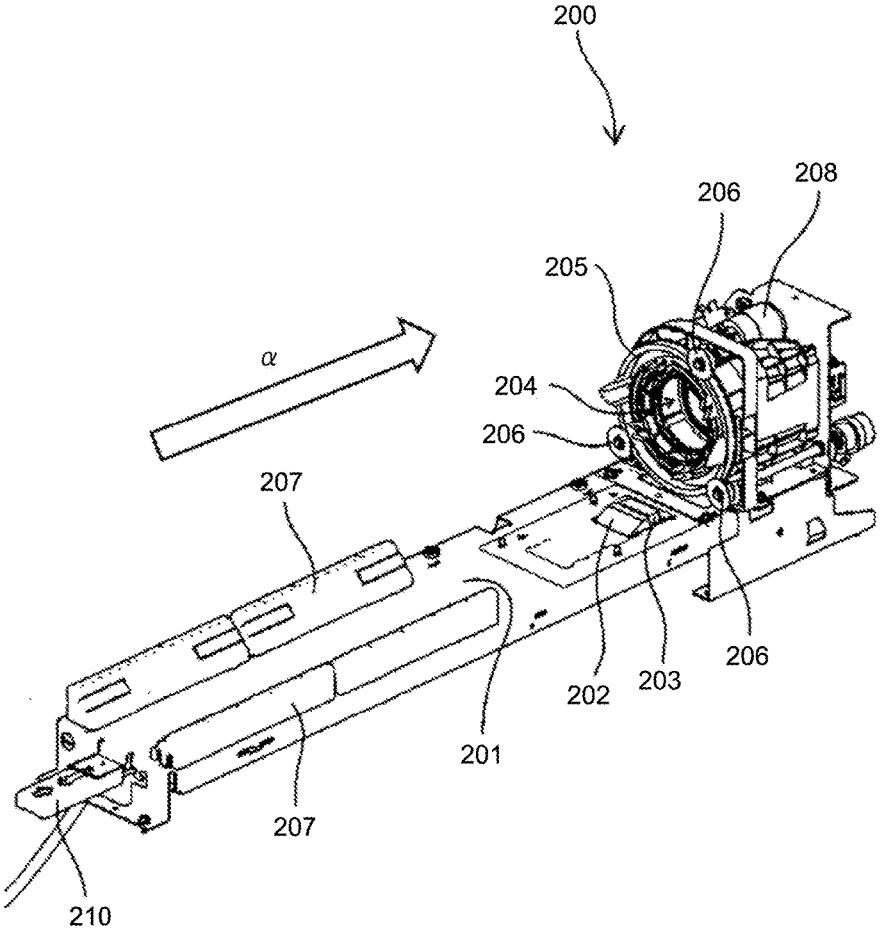
FIG. 15 is a perspective view of a container housing unit according to the embodiment from an upstream side in an insertion direction.

FIG. 15 is a perspective view of the container housing unit 200 in the present embodiment from the upstream side in the insertion direction.

An inner side where the toner container 100 is inserted inside the body of the copy machine 500 (a direction toward an output-side driving member 205, a direction of an arrow α in FIG. 15) is the downstream side in the insertion direction and the opposite side is the upstream side in the insertion direction.

In the container housing unit 200, the toner container 100 is placed on a container mounting section 201 and inserted in the insertion direction parallel to a central axis while being guided by a container supporting section 207. Insertion and setting of the opening portion 108 of the toner container 100 in a container inserting section 204 opens the inner lid 106. In addition, the output-side driving member 205 that outputs rotational drive from the body of the copy machine 500 to the toner container 100 is rotatably provided around the container inserting section 204, and this output-side driving member 205 is rotationally driven by a container driving motor 208.

The toner container 100 in the reference configuration example is rotated by engagement of the output-side driving member 205 with the drive receiving sections 110 of the toner container 100 and transmission of rotational drive of the output-side driving member 205 to the toner container 100.

A container pressing portion 202 and a container detecting portion 203 are provided in the container mounting section 201. These are energized upward from below, protrude above an upper surface of the container mounting section 201 before the toner container 100 is mounted, and withdraw, when the toner container 100 is placed thereon, downward under a weight of the toner container 100.

When the toner container 100 enters from the upstream side of the container mounting section 201 in the insertion direction, the container pressing portion 202 and the container detecting portion 203 are pressed by the cap member 102 of the toner container 100 and withdraw downward. Then, when the toner container 100 further enters to reach the inner part, a rear end of the cap member 102 (an upstream end in the insertion direction) passes over the container pressing portion 202. As a result, nothing presses the container pressing portion 202 downward, and thus the container pressing portion 202 returns to an upwardly protruding state with an energizing force. In this state, a downstream wall surface of the container pressing portion 202 in the insertion direction butts and is caught at the rear end of the cap member 102, which prevents the toner container 100 from coming off.

Furthermore, with the toner container 100 reaching the inner part, the cap member 102 is positioned above the container detecting portion 203, which withdraws downward under the weight of the cap member 102. Withdrawal of the container detecting portion 203 downward makes it possible to detect whether the toner container 100 is set in the container housing unit 200.

Push of a container unfixing lever 210 toward the downstream side in the insertion direction lowers the container pressing portion 202 to allow the toner container 100 to be pulled out.

Next, the output-side driving member 205 will be described.

Figure 16:
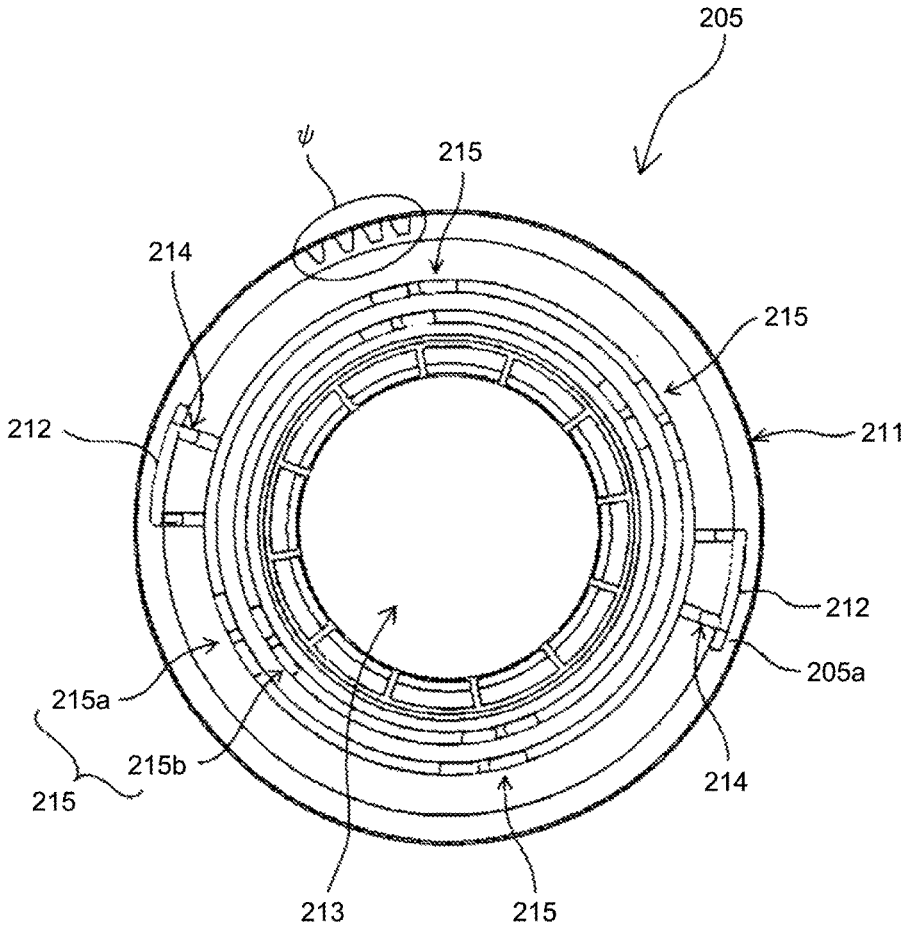
FIG. 16 is a front view of an output-side driving member according to the embodiment from an upstream side in an insertion direction.
Figure 17:
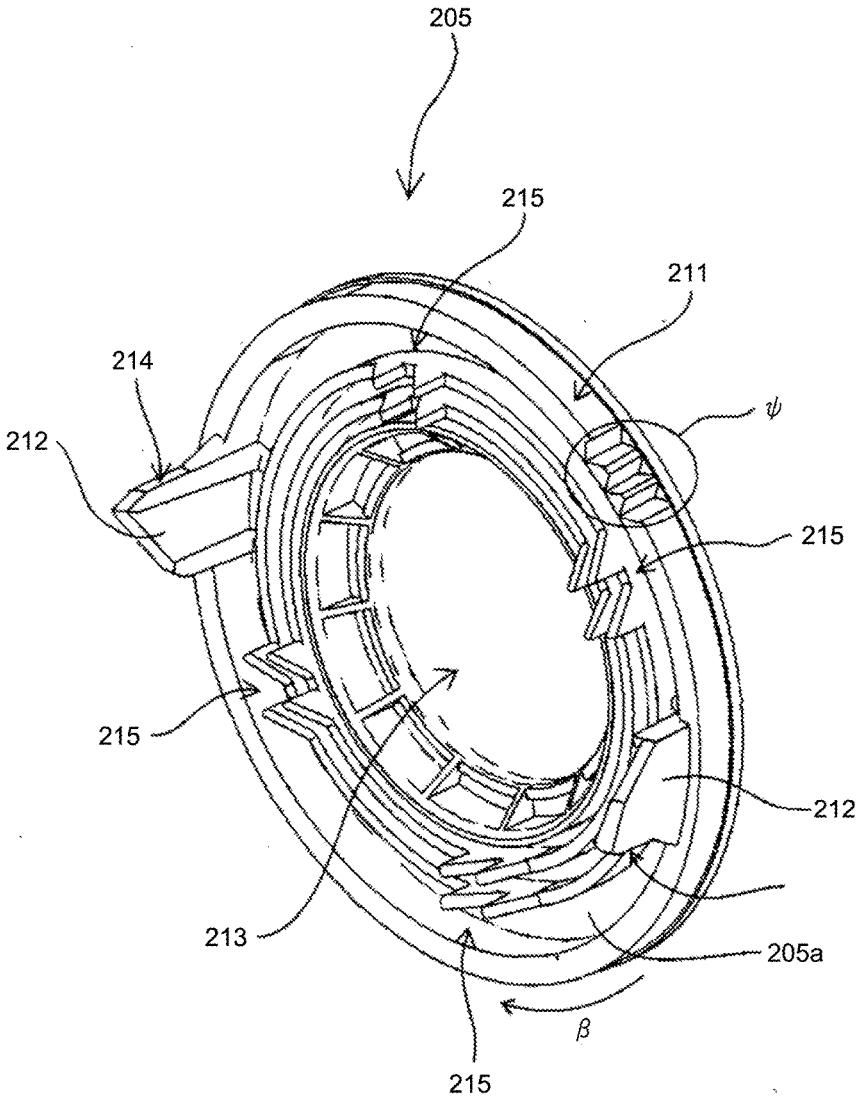
FIG. 17 is a perspective view of an output-side driving member according to the embodiment from an upstream side in an insertion direction.
Figure 18:
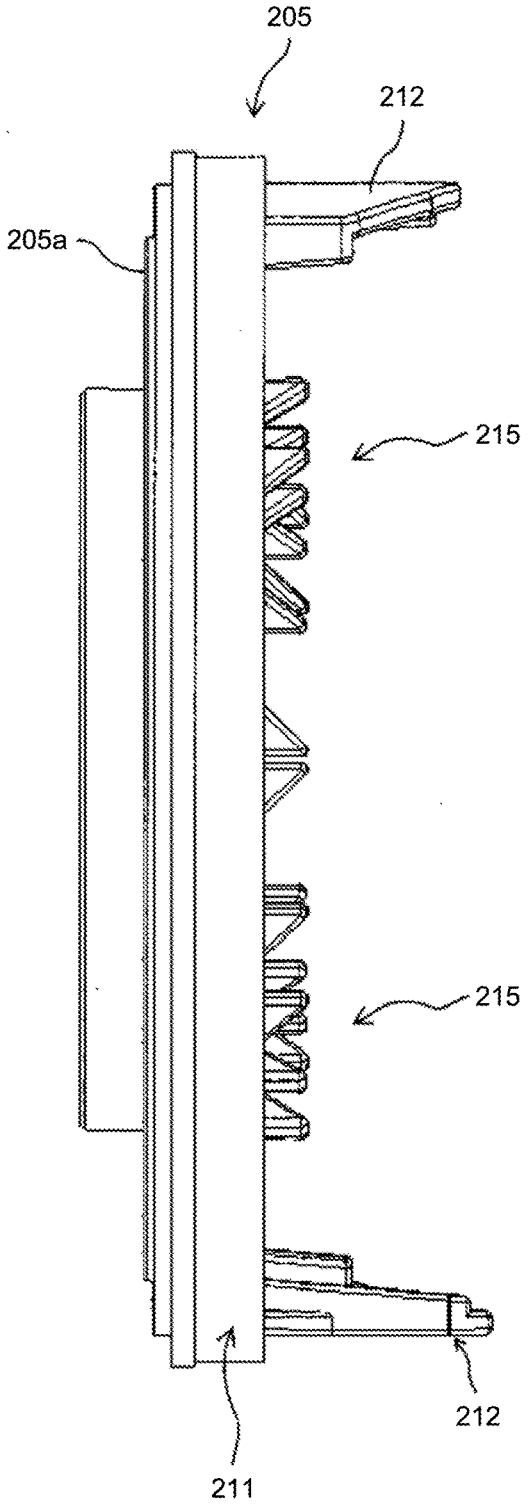
FIG. 18 is a side view of an output-side driving member according to the embodiment.

FIG. 16 is a front view of the output-side driving member 205 included in the body of the copy machine 500 in the present embodiment from the upstream side in the insertion direction. FIG. 17 is a perspective view of the output-side driving member 205 from the upstream side in the insertion direction, and FIG. 18 is a side view of the output-side driving member 205.

The output-side driving member 205 is a disk-shaped member and provided over an entire peripheral surface thereof with gear teeth 211 indicated in an area in FIGS. 16 and 17, respectively. A drive transmitting gear 206 of the container driving motor 208 is engaged with these gear teeth 211, which are rotationally driven by a driving force transmitted with rotation of the container driving motor 208. A circular opening is provided in a center of a disk-shaped output-side driving member body 205*a* of the output-side driving member 205 and serves as a container inserting opening 213. When the toner container 100 is mounted in the copy machine 500, the opening portion 108 of the toner container 100 is inserted into this container inserting opening 213.

The output-side driving member 205 includes two driving claws 212 extending toward the upstream side in the insertion direction against the output-side driving member body 205*a*. The output-side driving member body 205*a* is provided with an incompatible projection group 215 formed of a combination of a plurality of incompatible projections as an output-side incompatible section inside the driving claws 212 in the radial direction. The incompatible projection group 215 consists of an outer peripheral-side incompatible projection group 215*a* and an inner peripheral-side incompatible projection group 215*b* arranged concentrically at different distances from a rotational center line of the output-side driving member 205.

The incompatible projection group 215 consists of a plurality of projections protruding toward the upstream side in the insertion direction, and each projection inclines such that a protrusion amount increases from an upstream side to a downstream side in a rotational direction of the output-side driving member 205 to reach a top. The downstream side of the top in the rotational direction is formed of a surface parallel to the insertion direction. In other words, the surface rises vertically from an upstream surface of the output-side driving member body 205*a* in the insertion direction. The incompatible projection group 215 includes the outer peripheral-side incompatible projection group 215*a* and the inner peripheral-side incompatible projection group 215*b* each formed of sets of two projections, and a plurality of these sets is provided in the circumferential direction (four sets in the present embodiment). Additionally, as illustrated in FIG. 16, for example, the two driving claws 212 are provided opposed to each other at a distance of 180°.

A downstream side of each driving claw 212 in the rotational direction is provided with drive transmitting surface 214 formed of a wall surface along the insertion direction. In the toner container 100 in the reference configuration example, each drive transmitting surface 214 presses the drive-transmitted surface 125 of the drive receiving section 110 to function as a drive transmitting section.

Next, a behavior when the toner container 100 in the reference configuration example is inserted into the body of the copy machine 500 will be described.

The toner container 100 in the reference configuration example is inserted with positions of the drive-transmitted surface 125 in the drive receiving section 110 and the drive transmitting surface 214 of the output-side driving member 205 in the circumferential direction matched with each other. At this time, when incompatible shapes of the incompatible hole group 111 and the incompatible projection group 215 are matched with each other, the toner container 100 is completely inserted. When incompatible shapes are not matched with each other, the incompatible projection group 215 is not inserted into the incompatible hole group 111 to butt a downstream surface of the cap member 102 in the insertion direction where no hole is formed, and the toner container 100 is not inserted completely.

Examples where incompatible shapes are not matched with each other include a case where a positional relationship among holes included in the incompatible hole group 111 and one among projections included in the incompatible projection group 215 are different.

In a state where the toner container 100 is not inserted completely, the upstream end of the toner container 100 in the insertion direction protrudes from a near side (upstream side in the insertion direction) of the body of the copy machine 500, and an operator realizes that the toner container 100 is not inserted with a proper combination. Consequently, it is possible to prevent the toner containers 100 that store different kinds of toner (for example, different colors) in the body of the copy machine 500 from being erroneously set in positions where the toner containers 100 are supposed to be set.

EXAMPLES

Next, an example of a toner container 100 to which the present invention is applied will be described.

Figure 1:
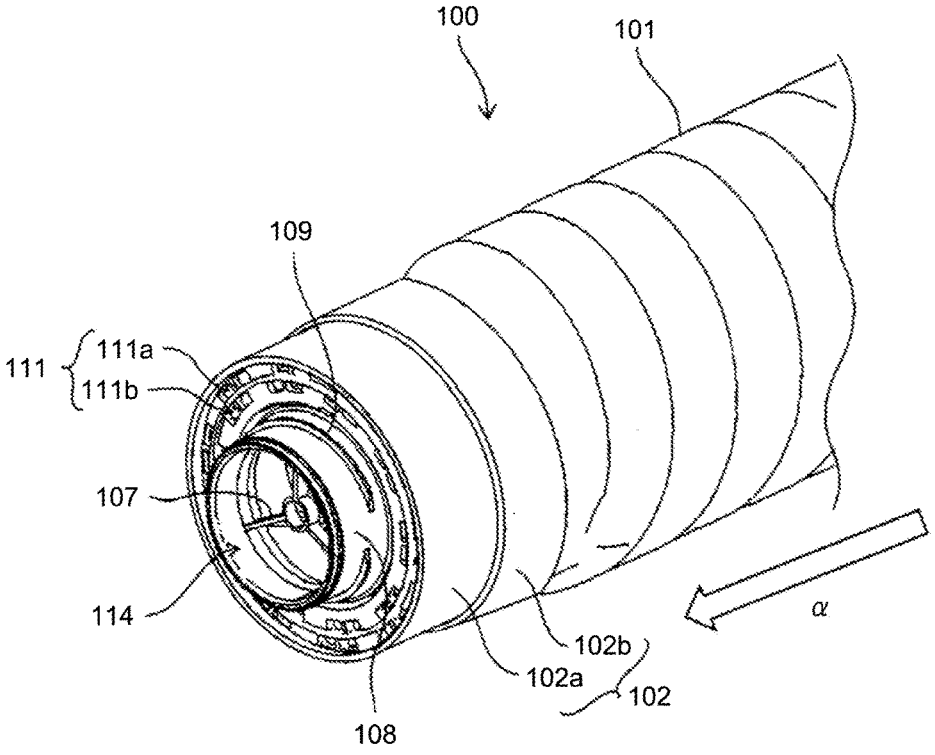
FIG. 1 is an enlarged perspective view of a toner container in an example near a downstream end in an insertion direction.
Figure 19:
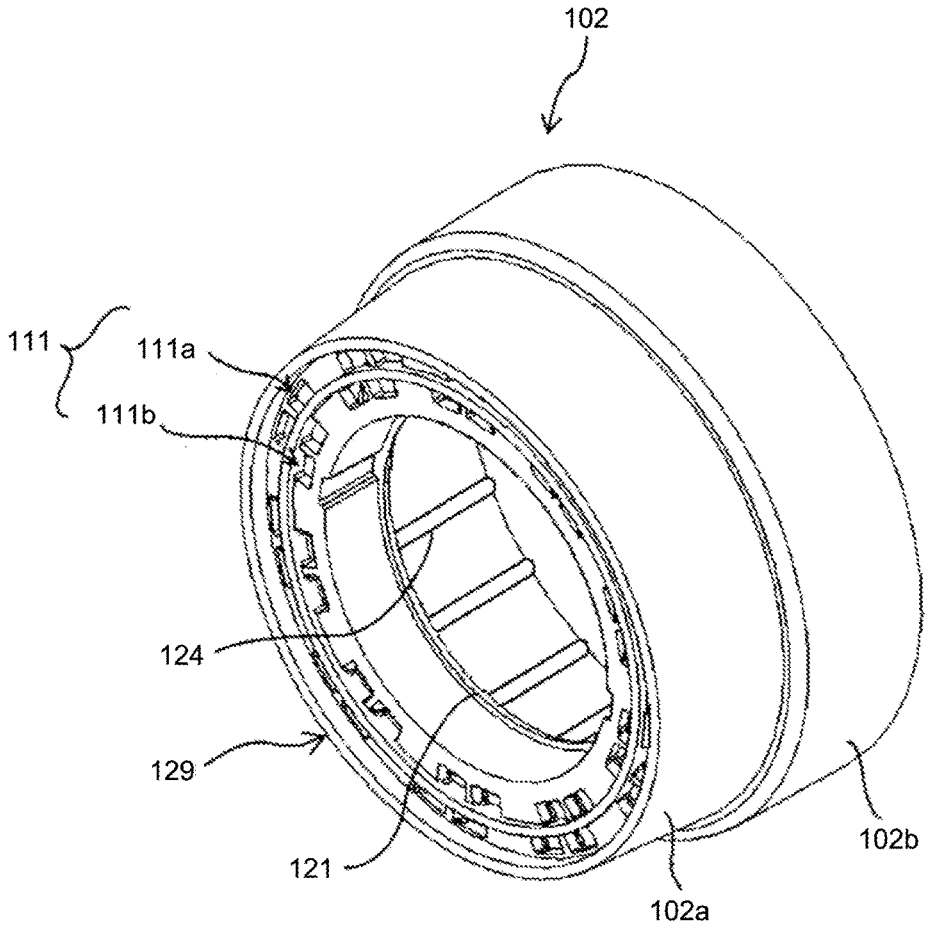
FIG. 19 is a perspective view of a cap member in the example from other end side (downstream side in an insertion direction)
Figure 20:
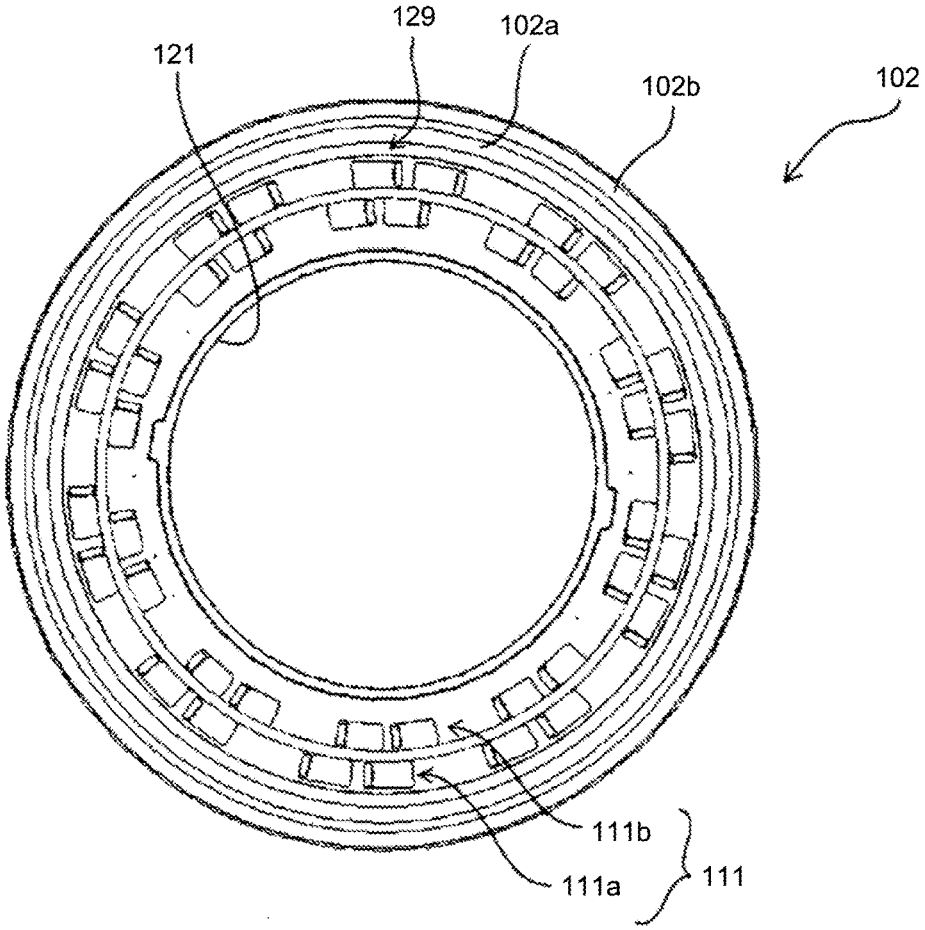
FIG. 20 is a front view of the cap member in the example from other end side (downstream side in an insertion direction)
Figure 21:
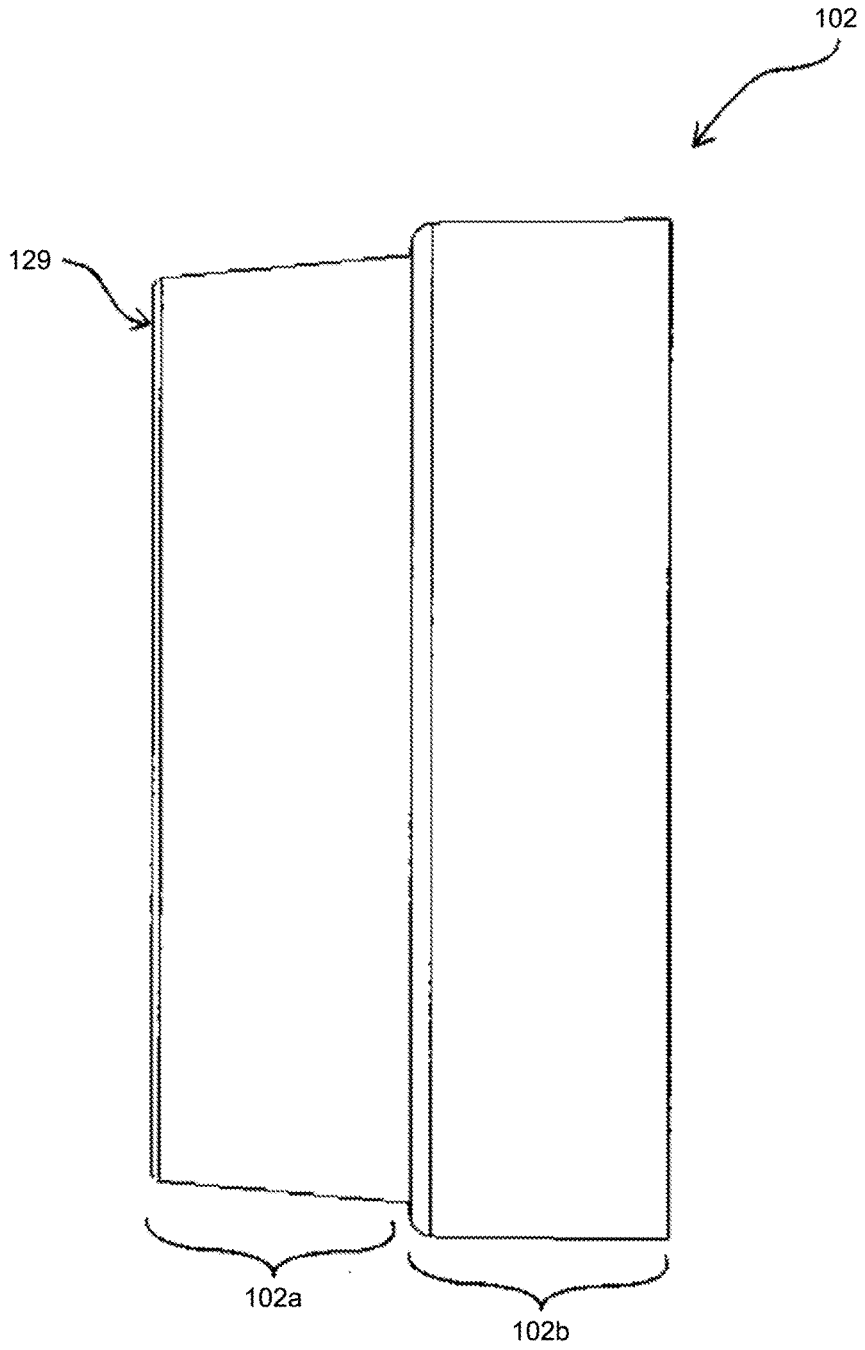
FIG. 21 is a side view of the cap member in the example.

FIG. 1 is an enlarged perspective view of the toner container 100 in the example near a downstream end in an insertion direction, and FIG. 19 is a perspective view of a cap member 102 in the example from other end side (downstream side in the insertion direction). In addition, FIG. 20 is a front view of the cap member 102 in the example from the other end side (downstream side in the insertion direction), and FIG. 21 is a side view of the cap member 102 in the example.

The toner containers 100 in the example and in the reference configuration example are different only in shape of an outer peripheral surface of the cap member 102, and common in terms of shape of a container body 101, configurations that fix the container body 101 and the cap member 102, and the like. Therefore, descriptions will be given to differences with descriptions of common points omitted appropriately.

As illustrated in FIGS. 1 and 19 to 21, the cap member 102 in the example consists of a cap front portion 102*a* positioned downstream in the insertion direction and a cap rear portion 102*b* positioned upstream in the insertion direction and larger in outer diameter than the cap front portion 102*a*. An incompatible hole group 111 similar to one in the reference configuration example described above is formed on a front end surface, a surface of the cap front portion 102*a* at a downstream end in the insertion direction. The outer peripheral surfaces of the cap front portion 102*a* and the cap rear portion 102*b* are curved surfaces without projections. Additionally, the outer diameter of the cap front portion 102*a* is smaller than an inner diameter of driving claws 212, a distance between two driving claws 212 of an output-side driving member 205.

The toner container 100 in the reference configuration example described above is provided with the drive receiving section 110 protruding toward the outer periphery of the cap member 102. In this way, with a shape protruding on the outer peripheral surface of the column-shaped toner container 100, when an external force is applied by, for example, a fall of the toner container 100, the force may be applied on one point in the protruding shape to cause damage to the protruding shape.

On the other hand, the toner container 100 in the example is not provided with a shape that is engaged with an engagement portion of the body of a copy machine 500 on the outer peripheral surface of the cap member 102, which is a curved surface without projections. Thus, compared with a configuration with projections, it is possible to increase an area the toner container 100 comes into contact with during a fall and disperse a force applied during a fall without concentrating on one point. In this way, in the toner container 100 in the example, there are no convex portions where a load is concentrated on one point on the outer peripheral surface of the column-shaped toner container 100, which can prevent damage to a part during a fall.

In the toner container 100 in the example, a container-side engagement portion into which drive is input is the incompatible hole group 111 consisting of a plurality of incompatible holes and not a convex portion even at the front end surface. Therefore, even when the toner container 100, for example, falls from the front end surface, there is no load concentrated in the container-side engagement portion without a convex portion, and it is possible to suppress damages to the container-side engagement portion having a function to receive rotational drive.

Besides, the container-side engagement portion having a function to receive rotational drive does not protrude on a surface of the toner container 100. Therefore, during attachment and detachment of the toner container 100, it is less likely for the container-side engagement portion to hit members of the device body. Consequently, it is possible to suppress damages to a portion having a function to receive rotational drive during the attachment and detachment of the toner container 100.

Figure 22:
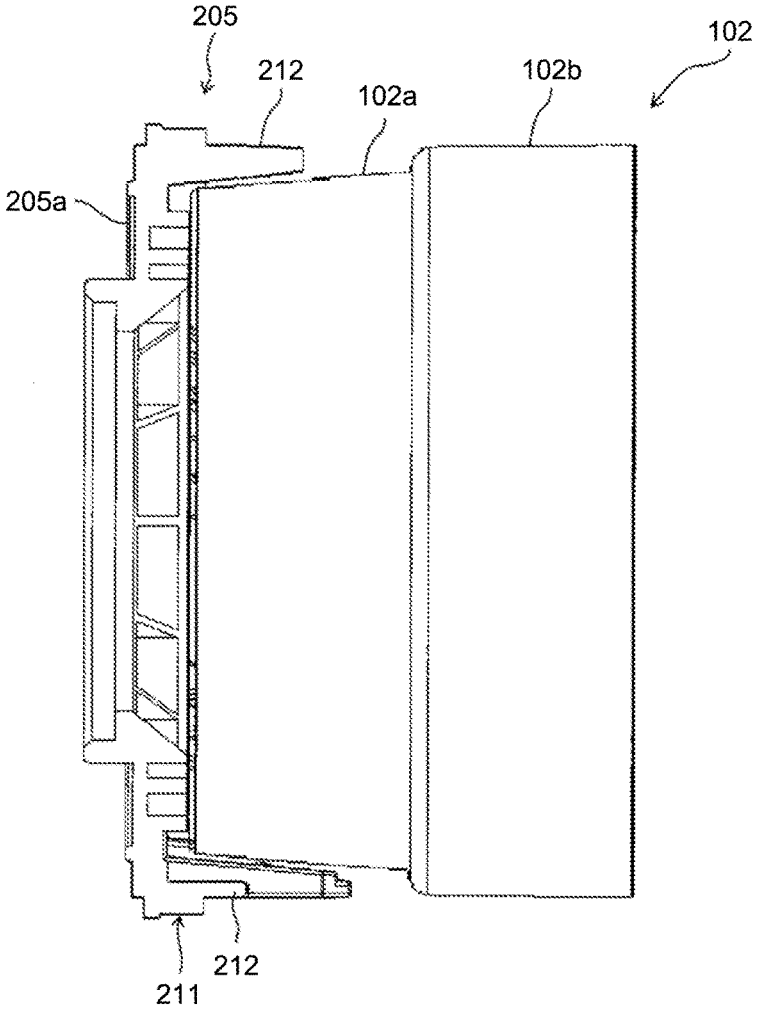
FIG. 22 is a side view of the cap member and an output-side driving member in the example.

FIG. 22 is a side view of the cap member 102 and the output-side driving member 205 with the toner container 100 in the example inserted into the body of the copy machine 500. In FIG. 22, for descriptive purposes, the output-side driving member 205 is indicated in a sectional view on a plane passing through a rotational center.

As illustrated in FIGS. 16 to 18, the output-side driving member 205 of the body of the copy machine 500 includes the driving claws 212 as a body-side engagement portion for transmitting rotational drive to the drive receiving section 110 of the toner container 100 in the reference configuration example. The output-side driving member 205 further includes an incompatible projection group 215 as an incompatible section for preventing erroneous setting of the toner container 100.

In inserting the toner container 100 in the example into the body of the copy machine 500, when incompatible shapes of the incompatible hole group 111 of the cap member 102 and the incompatible projection group 215 of the output-side driving member 205 are matched with each other, it is possible, as illustrated in FIG. 22, to completely insert the toner container 100.

The outer diameter of the cap front portion 102*a* is shorter than the distance between the two driving claws 212 of the output-side driving member 205. Therefore, as illustrated in FIG. 22, when the cap member 102 and the output-side driving member 205 are engaged with each other, the cap front portion 102*a* is positioned inside the driving claws 212 in the radial direction.

As illustrated in FIG. 22, the cap member 102 is not engaged with the driving claws 212 of the output-side driving member 205, and the incompatible projection group 215, an incompatible engagement portion of the body of the copy machine 500, is engaged with the incompatible hole group 111, an incompatible engagement portion of the cap member 102. Then, when the output-side driving member 205 is rotationally driven, the rotational drive is transmitted to the cap member 102 through the engagement portion between the incompatible projection group 215 and the incompatible hole group 111 to rotationally drive the toner container 100.

Figure 23:
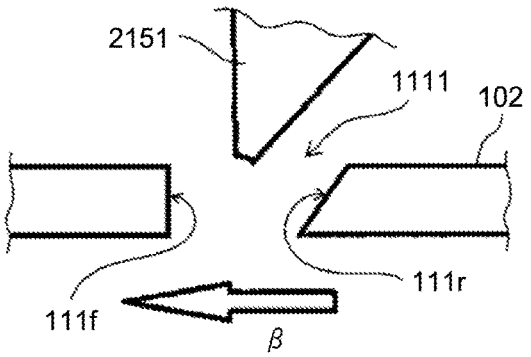
FIG. 23 is an enlarged sectional view of an incompatible projection and a front end surface of the cap member in the example with an incompatible hole formed.

FIG. 23 is an enlarged sectional view of an incompatible projection 2151, one of projections that form the incompatible projection group 215, and the front end surface of the cap member 102 with an incompatible hole 1111, one of holes that form the incompatible hole group 111. An arrow β in FIG. 23 indicates a rotational direction of the toner container 100, and a vertical direction in FIG. 23 is a direction parallel to a rotational center line (central axis).

As illustrated in FIG. 23, among surfaces that form the incompatible hole 1111, a downstream hole surface 111*f* facing upstream in the rotational direction is parallel to the rotational center line.

The parallelization of the downstream hole surface 111*f* to the rotational center line causes a rotational driving force input from the incompatible projection 2151 to act in a direction perpendicular to the downstream hole surface 111*f*. Therefore, it is possible to more reliably transmit the rotational driving force.

In addition, as illustrated in FIG. 23, among surfaces that form the incompatible hole 1111, an upstream hole surface 111*r* facing downstream in the rotational direction inclines against the rotational center line and has a shape whose opening width corresponding to a distance from the downstream hole surface 111*f* increases. Consequently, an opening width of the incompatible hole 1111 in a direction along the rotational direction increases toward the output-side driving member 205. With such a shape, even when a position of the incompatible projection 2151 relative to the incompatible hole 1111 in inserting the toner container 100 slightly deviates upstream in the rotational direction, the downstream hole surface 111*f* comes into contact with the incompatible projection 2151. When the toner container 100 is further inserted from this contact condition, a force to rotate upstream in the rotational direction (in a direction opposite to the direction during rotational driving) acts to the cap member 102, and the cap member 102 rotates to a position where positions of the incompatible hole 1111 and the incompatible projection 2151 in the circumferential direction are matched with each other. This makes it possible to completely insert the toner container 100.

Thus, even if positions of the incompatible projection 2151 and the incompatible hole 1111 slightly deviate from each other in the circumferential direction, a force correcting a positional relationship acts, which makes it easy to insert the incompatible projection 2151 into the incompatible hole 1111. This makes it easy to insert the toner container 100 into the body of the copy machine 500 when the incompatible shapes of the incompatible hole group 111 and the incompatible projection group 215 are matched with each other.

The output-side driving member 205 included in the copy machine 500 in the present embodiment is provided with the driving claws 212 along an outer periphery of the toner container 100.

These driving claws 212 transmit rotational drive to the drive receiving section 110 as a drive-input section provided on the outer peripheral surface of the cap member 102 of the toner container 100 in the reference configuration example. In contrast, the toner container 100 in the example is not provided with a drive-input section on the outer peripheral surface of the cap member 102. However, the smaller outer diameter of the cap front portion 102*a* in the example than the inner diameter of the driving claws 212 allows the cap member 102 to avoid the driving claws 212 and makes it possible to apply the toner container 100 in the example to the copy machine 500 including the driving claws 212.

In addition, even with the outer diameter of the cap front portion 102*a* made smaller in order to avoid the driving claws 212, it is necessary for the cap member 102 to be engaged with the container pressing portion 202 when the toner container 100 is mounted in the container housing unit 200 illustrated in FIG. 15. Therefore, the cap member 102 includes a cap rear portion 102*b* larger in outer diameter than the cap front portion 102*a*. This outer diameter of the cap rear portion 102*b* is set at a size for a downstream wall surface of the container pressing portion 202 in the insertion direction to butt an upstream end of the cap rear portion 102*b* in the insertion direction, when the toner container 100 is mounted in the container housing unit 200. Such setting makes it possible to engage the cap member 102 with the container pressing portion 202 when the toner container 100 is mounted in the container housing unit 200. This engagement can prevent the toner container 100 mounted in the copy machine 500 from falling off to retain the toner container 100 in the container housing unit 200.

Powder containers such as the toner container 100 for use in image forming devices such as the copy machine 500 have been standardized in device type and color in order to reduce costs. In addition, known is powder containers provided with device type- or color-incompatible container identification shapes with shapes of powder containers partially differentiated depending on types of powders such as toner to be stored.

The toner container 100 in the example can obtain an incompatible function by the difference in a position of an inner peripheral-side incompatible hole group 111*b* relative to an outer peripheral-side incompatible hole group 111*a* in the circumferential direction. Therefore, by differentiating the shape of the incompatible hole group 111 depending on differences in color of stored toner and device type of image forming devices, it is possible to standardize parts other than the shape of the incompatible hole group 111 while preventing erroneous setting. This makes it possible to reduce costs of the powder containers.

[Modifications]

Next, modifications of a toner container 100 to which the present invention is applied will be described.

Figure 24:
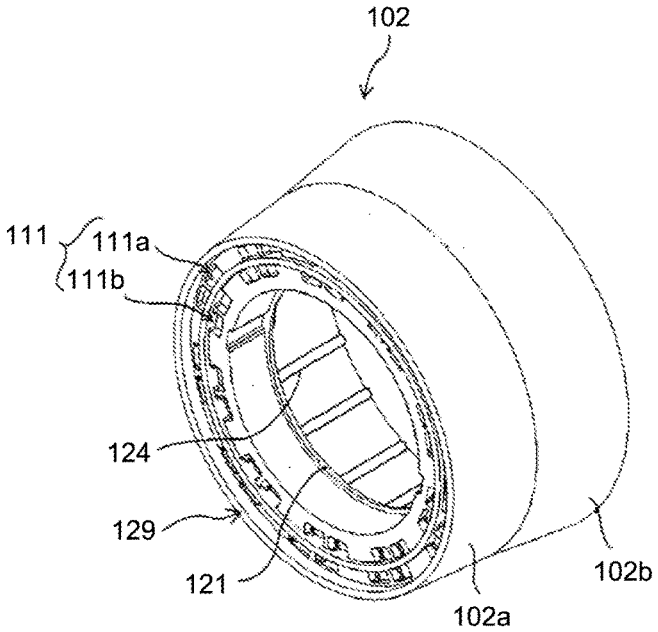
FIG. 24 is a perspective view of a cap member in a modification from other end side (downstream side in an insertion direction)
Figure 25:
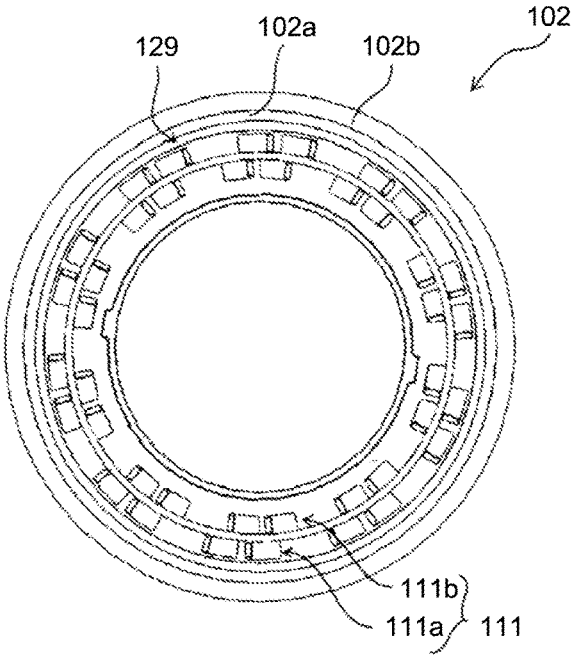
FIG. 25 is a front view of the cap member in the modification from other end side (downstream side in an insertion direction)
Figure 26:
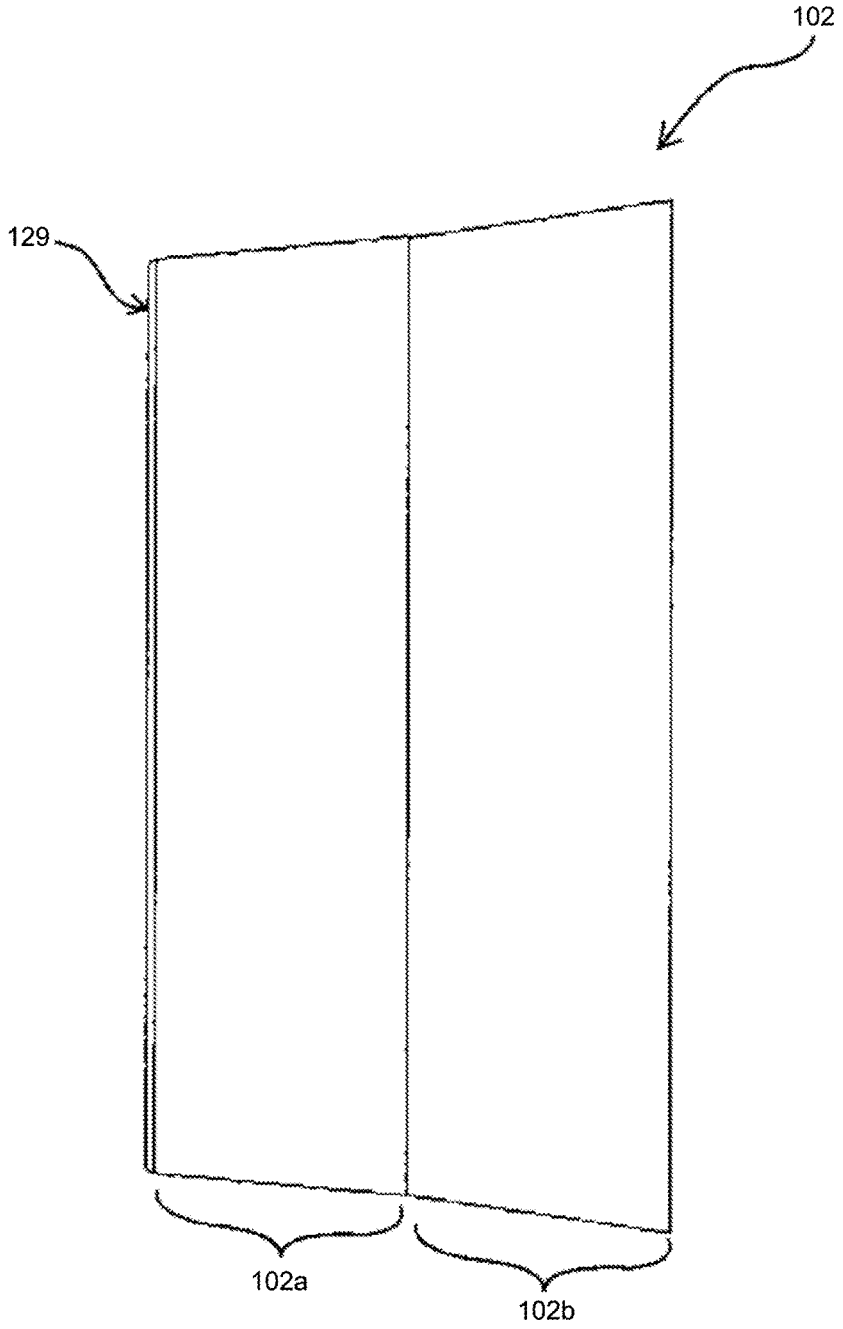
FIG. 26 is a side view of the cap member in the modification.
Figure 27:
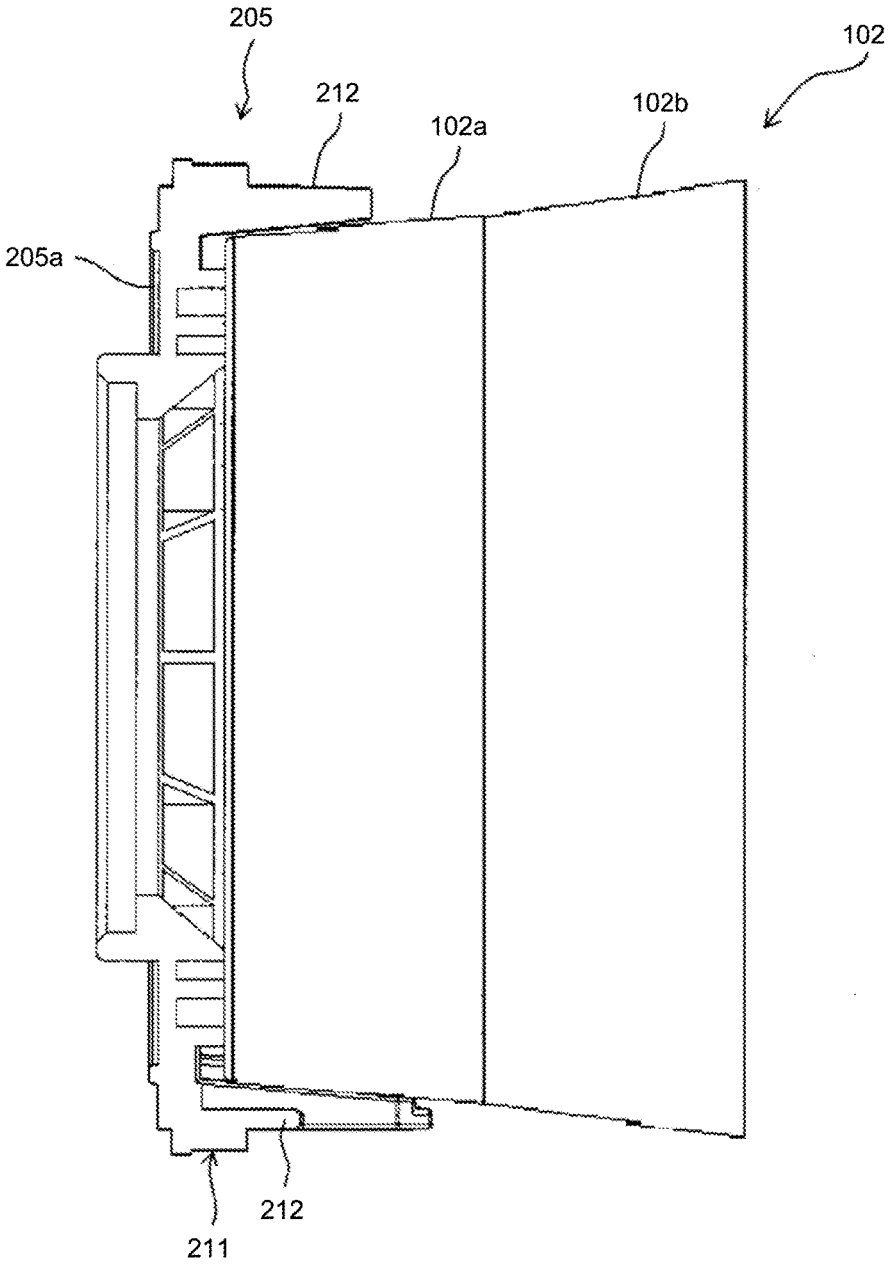
FIG. 27 is a side view of the cap member and an output-side driving member in the modification.

FIG. 24 is a perspective view of a cap member 102 of the toner container 100 in a modification from other end side (downstream side in an insertion direction). In addition, FIG. 25 is a front view of the cap member 102 in the modification from the other end side (downstream side in the insertion direction), and FIG. 26 is a side view of the cap member 102 in the modification. FIG. 27 is a side view of the cap member 102 and an output-side driving member 205 with the toner container 100 in the modification inserted in the body of a copy machine 500.

Figures 1, 28:
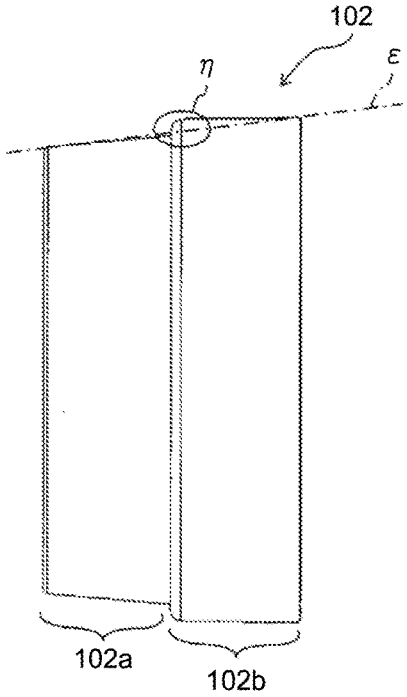
Figures 2, 28:
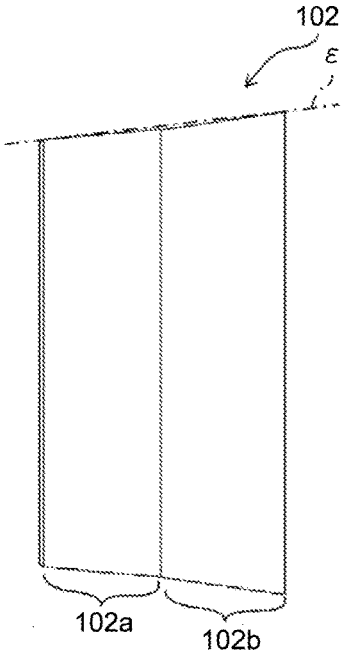

Furthermore, FIGS. 28-1 and 28-2 compare shapes of the cap member 102 in the example and in the modification. FIG. 28-1 is a side view of the cap member 102 in the example, while FIG. 28-2 is a side view of the cap member 102 in the modification.

The toner containers 100 in the modification and in the example are different only in shape of an outer peripheral surface of the cap member 102 and common in terms of other configuration. Therefore, descriptions will be given to differences with descriptions of common points omitted appropriately.

A one-dot chain line ε in FIGS. 28-1 and 28-2 each is a virtual straight line that connects a front end and a rear end on an outer peripheral section of the cap member 102.

The cap member 102 in the example includes, as illustrated in FIG. 28-1, a downstream portion of the cap rear portion 102*b* in the insertion direction (portion indicated with an area η in the figure) extending outside the one-dot chain line ε. On the other hand, the cap member 102 in the modification has, as illustrated in FIG. 28-2, a shape without a portion extending outside the one-dot chain line ε.

The shape of the cap member 102 in the modification eliminates protruding portions on the outer peripheral surface of the cap member 102. Therefore, there are no portions where a force is concentrated even when the toner container 100 falls, which makes it possible to further prevent damages to parts during the fall.

The toner containers 100 in the example and in the modification each have a configuration where the container body 101 that stores toner and the cap member 102 that includes a container-side engagement portion where rotational drive-input and incompatibility identification are carried out are separate members to fix. As a powder container to which the present invention is applied, a container-side engagement portion where rotational drive-input and incompatibility identification are carried out may be provided to a member included in a powder storage unit that stores powder.

In addition, the toner containers 100 in the example and in the modification each have a configuration where the entire toner container 100 is rotationally driven by input rotational drive, but may have a configuration where only a powder storage unit with toner stored is rotationally driven. Furthermore, a configuration may be acceptable where a member that forms a powder storage unit of the toner container 100 is not rotated, and a rotating member arranged therein is rotated to convey toner in a direction along a rotational center line.

What is described above is only an example, and the present invention can provide an advantageous effect specific to each of aspects below.

(Aspect A)

In a powder container such as a toner container 100 including a powder storage unit such as a container body 101 that stores powder such as toner, the powder storage unit or a rotating member arranged inside the powder storage unit is rotated by input of rotational drive of a drive output section such as an output-side driving member 205 of an image forming device such as a copy machine 500 in a state where the powder container is set in the image forming device, the powder container includes a container-side engagement portion such as an incompatible hole group 111 on an end surface such as a front end surface facing downstream in an insertion direction when the powder container is inserted in a direction parallel to a rotational center line of the rotational drive and set in the image forming device, the container-side engagement portion has a hole shape that is engaged with a body-side projection portion such as an incompatible projection group 215 of the drive output section, the body-side projection portion protruding upstream in the insertion direction, and the rotational drive is input by rotation of the drive output section in a state where the container-side engagement portion and the body-side projection portion are engaged with each other.

As described with respect to the above embodiment, this makes it possible, due to the provision of the container-side engagement portion having a hole shape on the end surface, to engage the body-side projection portion with the container-side engagement portion by an insertion movement of the powder container and input rotational drive. Then, the container-side engagement portion having a hole shape is not a part that protrudes on a surface of the powder container, and therefore, less likely to hit, for example, a floor and cause damages when the powder container falls, for example. Thus, in an aspect A, when the powder container falls, for example, it is possible to suppress damages to the container-side engagement portion that is a part having a function to receive rotational drive.

The shape of holes is not limited to a through hole passing through a member that forms the end surface, and may be a hollow with a depth enabling engagement with the body-side projection portion.

(Aspect B)

In the aspect A, the container-side engagement portion such as the incompatible hole group 111 includes, as a container identification shape having a color or a device-type incompatible function, a container first engagement portion such as an outer peripheral-side incompatible hole group 111*a* and a container second engagement portion such as an inner peripheral-side incompatible hole group 111*b* arranged in positions on the end surface such as the front end surface, distances of the positions from the rotational center line being different from each other, and a position of the container second engagement portion relative to the container first engagement portion in a circumferential direction is set to vary depending on a type of the powder container to be identified.

As described with respect to the above embodiment, this makes it possible to obtain an incompatible function by the difference in position of the container second engagement portion relative to the container first engagement portion in the circumferential direction. Besides, a part that forms a container identification shape is a container-side engagement portion having a hole shape, which makes it possible to suppress damages to the portion that forms the container identification shape when a powder container falls, for example.

(Aspect C)

In the aspect A or B, among surfaces that form the hole shape such as incompatible holes 1111 of the container-side engagement portion such as the incompatible hole group 111, a surface such as downstream hole surface 111*f* that faces upstream in a rotational direction when rotational drive is input, is parallel to the rotational center line.

As described with respect to the above embodiment, this makes it possible to more reliably transmit a rotational driving force input from the body-side projection portion such as the incompatible projection 2151.

(Aspect D)

In any one of the aspects A to C, an opening width of the hole shape such as the incompatible holes 1111 of the container-side engagement portion such as the incompatible hole group 111 in a direction along the rotational direction increases downstream in the insertion direction.

As described with respect to the above embodiment, this makes it easy to insert the body-side projection portion such as the incompatible projection 2151 into the hole shape of the container-side engagement portion.

(Aspect E)

In any one of the aspects A to D, a cap member such as a cap member 102 that covers an outer periphery at a front end of the powder container such as the container body 101 in the insertion direction is included, and the cap member has a shape without a portion extending outside a virtual straight line such as a one-dot chain line ε that connects a front end and a rear end of an outer peripheral section of the cap member.

As described with respect to the above embodiment, this eliminates protruding portions on the outer peripheral surface of the cap member, and thus there are no portions where a force is concentrated even when the powder container falls, for example, which makes it possible to further prevent damages to parts during the fall.

(Aspect F)

In any one of the aspects A to E, toner is stored as the powder.

As described with respect to the above embodiment, this makes it possible to suppress damages to the container-side engagement portion that is a part having a function to receive the rotational drive, when the powder container such as the toner container 100 that stores toner falls, for example.

(Aspect G)

In an image forming device such as the copy machine 500 including an image forming unit such as a printer unit 600 that forms an image on an image bearer such as a photoconductor 1 using powder for image forming such as toner, a powder conveying unit such as a toner supply device 70 that conveys the powder to the image forming unit, and a powder container that is attachably and detachably retained in the powder conveying unit, the powder container such as the toner container 100 according to any one of the aspects A to F is used as the powder container.

As described with respect to the above embodiment, this makes it possible to suppress damages to a portion having a function to receive the rotational drive in the powder container during attachment and detachment of the powder container.

REFERENCE SIGNS LIST

1Y YELLOW PHOTOCONDUCTOR
1 PHOTOCONDUCTOR
2Y YELLOW CHARGER
2 CHARGER
3 DISCHARGE LAMP
4 PHOTOCONDUCTOR CLEANING DEVICE
5 INTERMEDIATE TRANSFER BELT
6 PRIMARY TRANSFER ROLLER
6Y YELLOW PRIMARY TRANSFER ROLLER
7 SECONDARY TRANSFER ROLLER
8 FIXING ROLLER PAIR
9 DEVELOPING DEVICE
9Y YELLOW DEVELOPING DEVICE
11 SECONDARY TRANSFER COUNTER ROLLER
12 DRIVING ROLLER
13 CLEANING COUNTER ROLLER
14 TENSION ROLLER
15 SHEET CONVEYING BELT
16 SUPPORTING ROLLER PAIR
17 OPTICAL WRITING DEVICE
18 FIXING DEVICE
19 BELT CLEANING DEVICE
20 SUB-HOPPER
22 CONVEYING SCREW
23 TONER EJECTING OPENING PORTION
30 DIAPHRAGM PUMP
53 TUBE
54 TONER DUCT
60 TONER RECEIVING UNIT
61 CONTAINER
64 INLET
70 TONER SUPPLY DEVICE
92 DEVELOPING ROLLER
93 STIRRING AND CONVEYING SCREW

100 TONER CONTAINER
101 CONTAINER BODY
102 CAP MEMBER
102*a* CAP FRONT PORTION
102*b* CAP REAR PORTION
103 OUTER LID
106 INNER LID
107 EJECTING MEMBER
108 OPENING PORTION
109 OUTER LID FIXING PORTION
110 DRIVE RECEIVING SECTION
111 INCOMPATIBLE HOLE GROUP
111*b* INNER PERIPHERAL-SIDE INCOMPATIBLE HOLE GROUP
111*a* OUTER PERIPHERAL-SIDE INCOMPATIBLE HOLE GROUP
111*f* DOWNSTREAM HOLE SURFACE
111*r* UPSTREAM HOLE SURFACE
112 BOTTOM
113 CONVEYING GROOVE
114 OUTLET
115 CONTAINER SCOOPING PORTION
116 RETAINING PROJECTION
117 CIRCUMFERENTIAL-DIRECTION RESTRICTING PROJECTION
118 CIRCUMFERENCE DETERMINING PROJECTION
119 AXIAL-DIRECTION RESTRICTING PROJECTION
120 OPENING-PORTION BASE
121 RETAINING RIB
122 AXIAL-DIRECTION BUTTING SURFACE
123 CIRCUMFERENTIAL-DIRECTION RESTRICTING BUTTING PROJECTION
124 BACKLASH ELIMINATING PROJECTION
125 DRIVE-TRANSMITTED SURFACE
200 CONTAINER HOUSING UNIT
201 CONTAINER MOUNTING SECTION
202 CONTAINER PRESSING PORTION
203 CONTAINER DETECTING PORTION
204 CONTAINER INSERTING SECTION
205 OUTPUT-SIDE DRIVING MEMBER
205*a* OUTPUT-SIDE DRIVING MEMBER BODY
206 DRIVE TRANSMITTING GEAR
207 CONTAINER SUPPORTING SECTION
208 CONTAINER DRIVING MOTOR
210 CONTAINER UNFIXING LEVER
211 GEAR TEETH
212 DRIVING CLAW
213 CONTAINER INSERTING OPENING
214 DRIVE TRANSMITTING SURFACE
215 INCOMPATIBLE PROJECTION GROUP
215*b* INNER PERIPHERAL-SIDE INCOMPATIBLE PROJECTION GROUP
215*a* OUTER PERIPHERAL-SIDE INCOMPATIBLE PROJECTION GROUP
300 SCANNER
301 CONTACT GLASS
302 FIRST TRAVELING BODY
303 SECOND TRAVELING BODY
304 IMAGING FORMING LENS
305 READING SENSOR
400 AUTOMATIC ORIGINAL CONVEYING DEVICE
401 ORIGINAL PLATEN
500 COPY MACHINE
600 PRINTER UNIT
601 IN-PRINTER PAPER FEEDING ROUTE
602 REGISTRATION ROLLER PAIR
603 MANUAL PAPER FEEDING ROUTE
604 MANUAL PAPER FEEDING ROLLER
605 MANUAL PAPER FEEDING TRAY
606 PAPER EJECTING ROLLER PAIR
607 PAPER EJECTING TRAY
608 MANUAL PAPER SEPARATING ROLLER
700 PAPER FEEDING TABLE
701 PAPER FEEDING CASSETTE
702 PAPER FEEDING ROLLER
703 PAPER SEPARATING ROLLER
704 PAPER FEEDING ROUTE
705 CONVEYING ROLLER PAIR
1111 INCOMPATIBLE HOLE
2151 INCOMPATIBLE PROJECTION
Ly YELLOW OPTICAL BEAM
P SHEET

CITATION LIST

Patent Literature

Patent Literature 1: JP 6-214459 A

The invention claimed is:

1. A powder container comprising a powder storage configured to store powder, wherein the powder storage or a rotating member arranged inside the powder storage is rotated by input of rotational drive of a drive output section of an image forming device in a state where the powder container is set in the image forming device, the powder container includes a container-side engagement portion on an end surface facing downstream in an insertion direction when the powder container is inserted in a direction parallel to a rotational center line of the rotational drive and set in the image forming device, the container-side engagement portion has a hole that is engaged with a body-side projection portion of the drive output section, the body-side projection portion protruding upstream in the insertion direction, the rotational drive is input by rotation of the drive output section in a state where the container-side engagement portion and the body-side projection portion are engaged with each other, the container-side engagement portion includes, as a container identification shape having a color or a device-type incompatible function, a container first engagement portion and a container second engagement portion arranged in positions on the end surface, distances of the positions from the rotational center line being different from each other, and a position of the container second engagement portion relative to the container first engagement portion in a circumferential direction is set to vary depending on a type of the powder container to be identified.

2. The powder container according to claim 1, wherein, among surfaces that form the hole of the container-side engagement portion, a surface that faces opposite to a rotational direction when rotational drive is input, is parallel to the rotational center line.

3. The powder container according to claim 1, wherein an opening width of the hole of the container-side engagement portion increases downstream in the insertion direction.

4. The powder container according to claim 1, further comprising a cap member that covers an outer periphery at a front end of the powder container in the insertion direction, wherein the cap member has a shape without a portion extending outside a virtual straight line that connects a front end and a rear end of an outer peripheral section of the cap member.

5. The powder container according to claim 1, wherein toner is stored as the powder.

6. An image forming device, comprising:

an image forming unit configured to form an image on an image bearer using powder for image forming;

a powder conveyor configured to convey the powder to the image forming unit; and a powder container that is attachably and detachably retained in the powder conveyor, wherein the powder container according to claim 1 is used as the powder container.

* * * * *